US011183107B2

(12) United States Patent
Chun et al.

(10) Patent No.: US 11,183,107 B2
(45) Date of Patent: Nov. 23, 2021

(54) DISPLAY DEVICE AND METHOD OF DRIVING THE SAME

(71) Applicant: Samsung Display Co., Ltd., Yongin-si (KR)

(72) Inventors: Byung Ki Chun, Yongin-si (KR); Seung Jae Lee, Yongin-si (KR); Hae Kwan Seo, Yongin-si (KR); Chang Noh Yoon, Yongin-si (KR); Soon Dong Kim, Yongin-si (KR); Ji Hye Kim, Yongin-si (KR); Jun Gyu Lee, Yongin-si (KR); Jun Heyung Jung, Yongin-si (KR); Young Wook Yoo, Yongin-si (KR); Kuk Hwan Ahn, Yongin-si (KR); Hyun Jun Lim, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/918,454

(22) Filed: Jul. 1, 2020

(65) Prior Publication Data

US 2021/0027700 A1 Jan. 28, 2021

(30) Foreign Application Priority Data

Jul. 26, 2019 (KR) ..... 10-2019-0090995

(51) Int. Cl.
*G09G 3/32* (2016.01)
*G09F 9/30* (2006.01)

(52) U.S. Cl.
CPC ..... *G09G 3/32* (2013.01); *G09F 9/301* (2013.01); *G09G 2310/0278* (2013.01)

(58) Field of Classification Search
CPC ..... G09G 3/32; G09G 2360/16; G09G 2340/0464; G09G 2340/0407; G09G 2300/0861; G09G 2320/0686; G09G 2310/0262; G09G 2300/0842; G09G 2310/0251; G09G 3/3233; G09G 3/3266; G09G 2330/021; G09G 2310/0286;
(Continued)

(56) References Cited

U.S. PATENT DOCUMENTS 9,448,660 B2 * 9/2016 Seo ..... G06F 3/0481
9,734,801 B2 8/2017 Noh et al.
(Continued)

FOREIGN PATENT DOCUMENTS

KR 10-2016-0043548 A 4/2016
KR 10-2016-0108705 A 9/2016
(Continued)

*Primary Examiner* — Muhammad N Edun
(74) *Attorney, Agent, or Firm* — Lewis Roca Rothgerber Christie LLP

(57) ABSTRACT

A display device including: a first pixel region including first pixels connected to a data line and first scan lines; a second pixel region in contact with the first pixel region at a first boundary and including second pixels connected to the data line and second scan lines; and a third pixel region in contact with the second pixel region at a second boundary and including third pixels connected to the data line and third scan lines, wherein the display device is configured to scale an image displayed in the second pixel region one or more times based on the second pixel region maintaining a folded state.

20 Claims, 19 Drawing Sheets

(58) Field of Classification Search
CPC ..... G09G 2300/0819; G09G 2380/02; G09G 2320/043; G09G 2310/0278; G09G 2310/0221; G09G 2310/0213; G09G 2320/046; G09G 2310/0218; G09G 3/035; G09G 2340/0435; G09F 9/301
See application file for complete search history.

(56) References Cited

U.S. PATENT DOCUMENTS

| | | | | |
|---|---|---|---|---|
| 10,163,380 | B2 | 12/2018 | Chun et al. | |
| 10,209,878 | B2 | 2/2019 | Sang et al. | |
| 2018/0158396 | A1* | 6/2018 | Lee | G09G 3/2092 |
| 2018/0246628 | A1* | 8/2018 | Sang | G06F 3/017 |
| 2018/0261163 | A1* | 9/2018 | Hyun | G09G 3/3266 |
| 2018/0322831 | A1 | 11/2018 | Kim et al. | |
| 2018/0330671 | A1* | 11/2018 | Kim | G09G 3/3225 |
| 2018/0342192 | A1 | 11/2018 | Lee et al. | |
| 2021/0027697 | A1 | 1/2021 | Yoon et al. | |

FOREIGN PATENT DOCUMENTS

| | | | |
|---|---|---|---|
| KR | 10-2016-0132170 | A | 11/2016 |
| KR | 10-2016-0137867 | A | 12/2016 |
| KR | 10-2018-0121747 | A | 11/2018 |

* cited by examiner

DISPLAY DEVICE AND METHOD OF DRIVING THE SAME

CROSS-REFERENCE TO RELATED APPLICATION

This application claims priority to and the benefit of Korean Patent Application No. 10-2019-0090995 filed in the Korean Intellectual Property Office on Jul. 26, 2019, the entire contents of which are incorporated herein by reference.

BACKGROUND

1. Field

Aspects of some example embodiments of the present disclosure relates to a display device and a method of driving the display device.

2. Description of the Related Art

With the development of an information technology, display devices, which provide a connection medium between a user and information, are becoming more important. In response to this, display devices such as liquid crystal display devices, organic light emitting display devices, and plasma display devices are increasingly used.

Recently, by adopting a flexible board to a display panel, various products such as a foldable display device, a rollable display device, and a stretchable display device have been developed and launched.

For example, the foldable display device may be configured to display an image on the entire pixel unit in an unfolded state and to display the image only on a part of the pixel unit in a folded state.

In this case, the degree or rate of degradation of pixels may differ between a region of the pixel unit in which the image is displayed in both the folded state and the unfolded state, and a region of the pixel unit in which the image is displayed only in the unfolded state. That is, the degree or rate of degradation of pixels may differ in different areas, and users may visually recognize a boundary between the different areas.

Further, it may be desirable to reduce power consumption for a region where no image is displayed or a black image is displayed in the folded state.

The above information disclosed in this Background section is only for enhancement of understanding of the background and therefore the information discussed in this Background section does not necessarily constitute prior art.

SUMMARY

Aspects of some example embodiments of the present disclosure may include a display device and a method of driving the display device which may prevent or reduce differences in a degree or rate of degradation of pixels in different areas or regions and reduce power consumption in a folded state.

A display device according to some example embodiments of the present disclosure includes a first pixel region including first pixels connected to a data line and first scan lines; a second pixel region which is in contact with the first pixel region at a first boundary and includes second pixels connected to the data line and second scan lines; and a third pixel region which is in contact with the second pixel region at a second boundary and includes third pixels connected to the data line and third scan lines. While the second pixel region maintains a folded state, an image displayed in the second pixel region is scaled one or more times.

According to some example embodiments, while the second pixel region maintains a folded state, the first pixel region may display an unscaled image.

According to some example embodiments, while the second pixel region maintains the folded state, an image displayed in the first pixel region and an image displayed in the second pixel region may be seamless at the first boundary.

According to some example embodiments, while the second pixel region maintains the folded state, the third pixel region may not display an image or display a black image, and second pixels, which are in contact with the second boundary, of the second pixel region may not display the image or display the black image.

According to some example embodiments, a first image region, which is in contact with the first boundary, of an image in the second pixel region may be up-scaled, and a second image region, which is in contact with the second boundary, of an image in the second pixel region may be down-scaled.

According to some example embodiments, as the first image region and the second image region increase, a display region in the second pixel region may increase and a non-display region in the second pixel region may decrease.

According to some example embodiments, a first image region, which is in contact with the first boundary, of an image in the second pixel region may be down-scaled, and a second image region, which is in contact with the second boundary, of an image in the second pixel region may be up-scaled.

According to some example embodiments, as the first image region and the second image region increase, a display region in the second pixel region may decrease and a non-display region in the second pixel region may increase.

According to some example embodiments, while the second pixel region maintains the folded state, the first pixels and the second pixels in contact with the first boundary may update images at a first cycle, and the third pixels and the second pixels in contact with the second boundary may update images at a second cycle, and the first cycle may be shorter than the second cycle.

According to some example embodiments, while the second pixel region maintains the folded state, a supply of scan signals of a turn-on level to scan off lines which are a part of the second scan lines may be stopped for at least one frame period, and the number of the scan off lines may be changed one or more times.

According to some example embodiments, the number of times that the number of the scan off lines is changed may be less than or equal to the number of times that the image displayed in the second pixel region is scaled.

A display device according to some example embodiments of the present disclosure includes a first pixel region including first pixels connected to a data line and first scan lines; a second pixel region which is in contact with the first pixel region at a first boundary and includes second pixels connected to the data line and second scan lines; and a third pixel region which is in contact with the second pixel region at a second boundary and includes third pixels connected to the data line and third scan lines. While the second pixel region maintains a folded state, a supply of scan signals of a turn-on level to scan off lines which are a part of the second scan lines is stopped for at least one frame period, and the number of the scan off lines is changed one or more times.

According to some example embodiments, while the second pixel region maintains the folded state, an image displayed in the second pixel region may be scaled one or more times.

According to some example embodiments, the number of times that the number of the scan off lines is changed may be equal to or less than the number of times that the image displayed in the second pixel region is scaled.

According to some example embodiments, in a method of driving a display device including a first pixel region which includes first pixels connected to a data line and first scan lines, a second pixel region which is in contact with the first pixel region at a first boundary and includes second pixels connected to the data line and second scan lines, and a third pixel region which is in contact with the second pixel region at a second boundary and includes third pixels connected to the data line and third scan lines includes: displaying images in the first pixel region, the second pixel region, and the third pixel region when the second pixel region is in an unfolded state; detecting that the second pixel region is in a folded state; and scaling the image displayed in the second pixel region one or more times while the second pixel region maintains the folded state.

According to some example embodiments, while the second pixel region maintains the folded state, the first pixel region may display an unscaled image, and the image displayed in the first pixel region and the image displayed in the second pixel region may be seamless at the first boundary.

According to some example embodiments, while the second pixel region maintains the folded state, the third pixel region may not display an image or display a black image, and second pixels, which are in contact with the second boundary, of the second pixel region may not display the image or display the black image.

According to some example embodiments, in the scaling, when a first image region, which is in contact with the first boundary, of an image in the second pixel region may be up-scaled, a second image region, which is in contact with the second boundary, of an image in the second pixel region may be down-scaled, and when the first image region is down-scaled, the second image region may be up-scaled.

According to some example embodiments, the method may further include stopping a supply of scan signals of a turn-on level to scan off lines which are a part of the second scan lines for at least one frame period, and changing the number of the scan off lines one or more times, while the second pixel region maintains the folded state.

According to some example embodiments, the number of times that the number of the scan off lines is changed may be less than or equal to the number of times that the image displayed in the second pixel region is scaled.

A display device and a method driving the display device according to some example embodiments of the present disclosure may prevent or reduce rapid changes in a degree or rate of degradation degree of pixels at a specific boundary and may reduce power consumption in a folded state.

DETAILED DESCRIPTION

Figure 1:
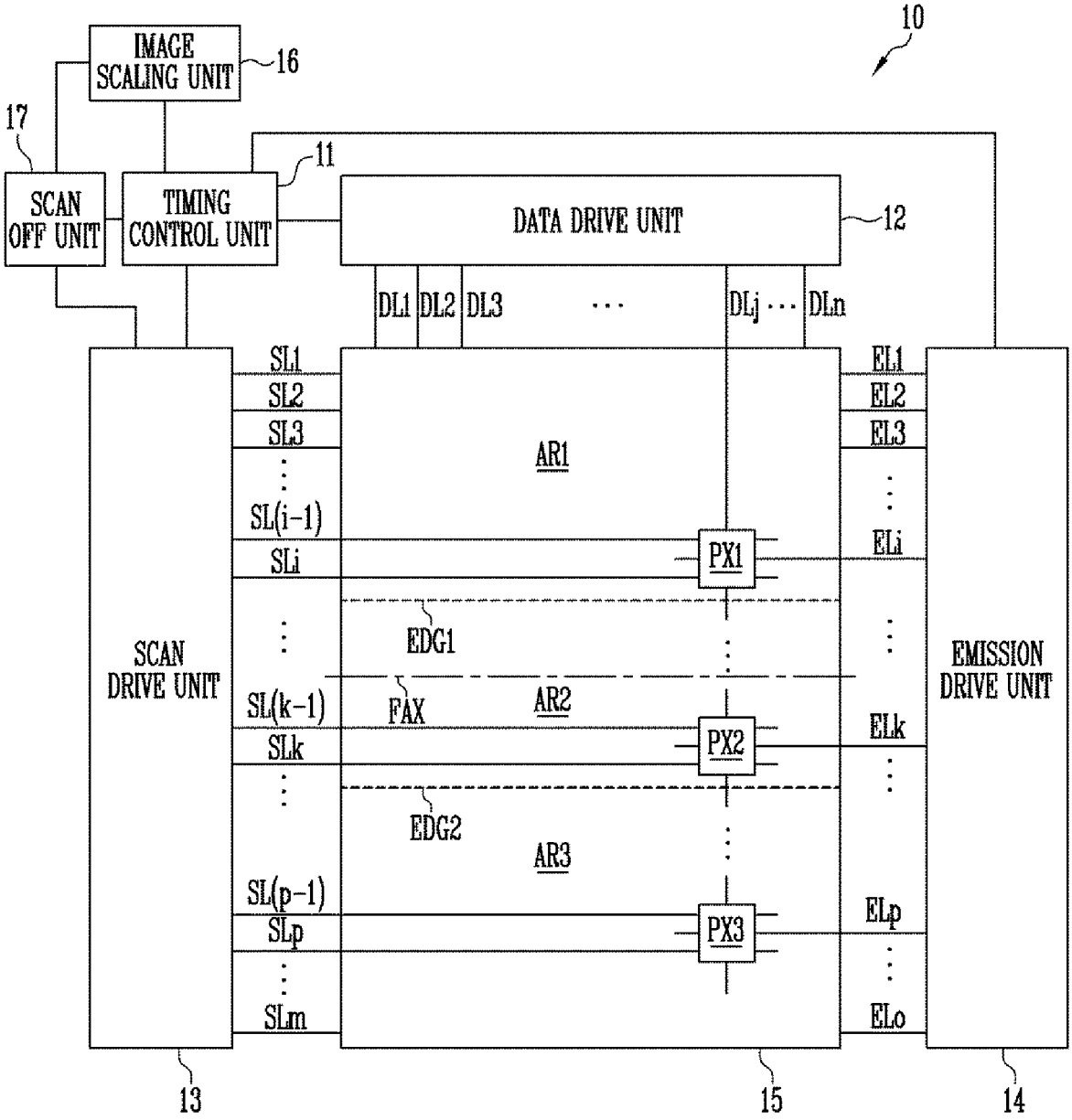
FIG. 1 is a diagram illustrating a display device according to some example embodiments of the present disclosure.

Hereinafter, aspects of various example embodiments of the present disclosure will be described in more detail with reference to the accompanying drawings such that those skilled in the art may easily implement the present disclosure. The present disclosure may be embodied in many different forms and is not limited to the example embodiments described herein. Embodiments according to the present disclosure may be used in combination with each other or may be used independently of each other.

In order to clearly describe the present disclosure, parts irrelevant to understanding the description may be omitted, and the same or similar configuration elements are denoted by the same reference numerals throughout the specification. Thus, the aforementioned reference numerals may be used in other drawings.

In addition, because a size and a thickness of each configuration illustrated in the drawings are arbitrarily illustrated for the sake of convenient description, embodiments according to the present disclosure are not necessarily limited to the sizes and thicknesses illustrated. That is, in the drawings, the sizes and thicknesses of various components may be exaggerated to more clearly represent various layers and areas.

FIG. 1 is a diagram illustrating a display device according to some example embodiments of the present disclosure.

Referring to FIG. 1, a display device 10 according to some example embodiments of the present disclosure may optionally include a timing control unit 11, a data drive unit 12, a scan drive unit 13, an emission drive unit 14, a pixel unit 15, an image scaling unit 16, and a scan off unit 17.

The timing control unit 11 may receive grayscale values and control signals for each image frame from an external processor. The timing control unit 11 may provide the data drive unit 12, the scan drive unit 13, the emission drive unit 14, and the like with control signals suitable for each specification so as to display an image corresponding to an image frame.

The timing control unit 11 may render the grayscale values so as to correspond to a specification of the pixel unit 15. For example, the external processor may provide a red grayscale value, a green grayscale value, and a blue grayscale value for each unit dot. However, for example, when the pixel unit 15 has a Pentile structure, adjacent unit dots may share the pixel, and thereby, the pixels may not correspond one-to-one to each grayscale value. In this case, rendering of the grayscale value may be performed. When the pixels correspond one-to-one to each grayscale value, rendering of the grayscale value may not be performed.

The grayscale values rendered or not rendered may be provided to the data drive unit 12 or the image scaling unit 16. For example, when a second pixel region AR2 is in an unfolded state, the grayscale values may be directly provided to the data drive unit 12. For example, when the second pixel region AR2 is in a folded state, at least some of the grayscale values may be provided to the data drive unit 12 after being converted by the image scaling unit 16.

The image scaling unit 16 may convert the grayscale values such that an image displayed in the second pixel region AR2 is scaled one or more times while the second pixel region AR2 maintains the folded state. The image scaling unit 16 may provide the scan off unit 17 with scan off line information, based on the converted grayscale values.

The data drive unit 12 may generate data voltages to be provided to the data lines DL1, DL2, DL3, DLj, and DLn by using the grayscale values and the control signals. For example, the data drive unit 12 samples the grayscale values by using a clock signal and applies data voltages corresponding to the grayscale values to the data lines DL1 to DLn in units of pixel rows (for example, pixels connected to the same scan line). j and n may be integers greater than zero.

The scan drive unit 13 may receive a clock signal, a scan start signal, and the like from the timing control unit 11 and generate scan signals to be provided to the scan lines SL1, SL2, SL3, SL(i−1), SLi, SL(k−1), SLk, SL(p−1), SLp, and SLm. i, k, p, and m may be integers greater than zero. k may be an integer greater than i. p may be an integer greater than k. m may be an integer greater than p.

The scan drive unit 13 may sequentially supply the scan signals having pulses of a turn-on level to the scan lines SL1 to SLm. The scan drive unit 13 may include a scan stage configured in a form of a shift register. The scan drive unit 13 may generate the scan signals in a manner in which the scan start signals in the form of a pulse of a turn-on level are sequentially transmitted to the next scan stage under a control of the clock signal.

The first scan lines SL1 to SLi may be connected to first pixels PX1 in the first pixel region AR1. The second scan lines SL(k−1) and SLk may be connected to second pixels PX2 in the second pixel region AR2. The third scan lines SL(p−1), SLp, and SLm may be connected to third pixels PX3 in the third pixel region AR3.

The scan off unit 17 may stop a supply of the scan signals of a turn-on level to the scan off lines which are a part of the second scan lines SL(k−1) and SLk during one or more frame periods, based on the scan off line information. During the period in which the supply of the scan signals of a turn-on level to the scan off lines is stopped, the supply of the scan signals of a turn-on level to all the third scan lines SL(p−1), SLp, and SLm may be stopped.

The emission drive unit 14 may receive the clock signal, a light emission stop signal, and the like from the timing control unit 11 and generate light emission signals to be provided to the light emission lines EL1, EL2, EL3, ELi, ELk, ELp, and ELo. o may be an integer greater than zero. o may be an integer greater than p. For example, the emission drive unit 14 may sequentially provide the light emission signals having pulses of a turn-off level to the light emission lines EL1 to ELo. For example, each light emission stage of the emission drive unit 14 may be configured in the form of a shift register, and may generate the light emission signals in the manner in which the light emission stop signals in the form of a pulse of a turn-off level are sequentially transmitted to the next light emission stage under a control of the clock signal. According to some example embodiments, the emission drive unit 14 may be omitted depending on circuit configurations of the pixels PX1, PX2, and PX3.

The pixel unit 15 may include the first pixel region AR1, the second pixel region AR2, and the third pixel region AR3. The first pixel region AR1 may include the first pixel PX1 connected to the data line DLj and the first scan lines SL1 to SLi. The second pixel region AR2 may be in contact with the first pixel region AR1 at a first boundary EDG1 and include the second pixel The pixel PX2 connected to the data line Dj and the second scan lines SL(k−1) and SLk. The third pixel region AR3 may be in contact with the second pixel region AR2 at a second boundary EDG2 and include the third pixel PX3 connected to the data line DLj and the third scan lines.

Each of the pixels PX1, PX2, and PX3 may be connected to a corresponding data line, a corresponding scan line, and a corresponding light emission line. According to some example embodiments, when the emission drive unit 14 is omitted, the pixels PX1, PX2, and PX3 may not be connected to the light emission lines EU to ELo. In the first pixel PX1, a scan input terminal may be connected to the i-th scan line SLi, and a data input terminal may be connected to the j-th data line DLj. In the second pixel PX2, a scan input terminal may be connected to the k-th scan line SLk, and a data input terminal may be connected to the j-th data line DLj. In the third pixel PX3, a scan input terminal may be connected to the p-th scan line SLp, and a data input terminal may be connected to the j-th data line DLj.

A folding axis FAX may be located between the first boundary EDG1 and the second boundary EDG2. The folding axis FAX may overlap the second pixel region AR2. That is, when the display device 10 is folded, the second pixel region AR2 may be folded. At this time, the first pixel region AR1 and the third pixel region AR3 may be kept flat. The second pixel region AR2 may be referred to as a folding region.

According to some example embodiments, the folding axis FAX may be physically defined. For example, the display device 10 may further include a mechanical structure such that the display device 10 is configured to be folded or unfolded only on the folding axis FAX. In this configuration, the folding axis FAX may be fixed. At this time, the pixel regions AR1, AR2, and AR3 may be fixed regions. According to some example embodiments, a mount that covers the display panel in the display device 10 may also be flexible. In such embodiments, the location of the folding axis FAX may vary, and the location of the pixel regions AR1, AR2, and AR3 may vary. In such embodiments, the display device 10 may further include a pressure sensor, a bending sensor, a resistance sensor, and the like to detect a location of the folding axis FAX.

In FIG. 1, for the purpose of a location comparison, the first pixel PX1, the second pixel PX2, and the third pixel PX3 are illustrated as being connected to the same data line DLj. However, according to various embodiments, the first pixel PX1, the second pixel PX2, and the third pixel PX3 may be connected to data lines different from each other.

Figure 2:
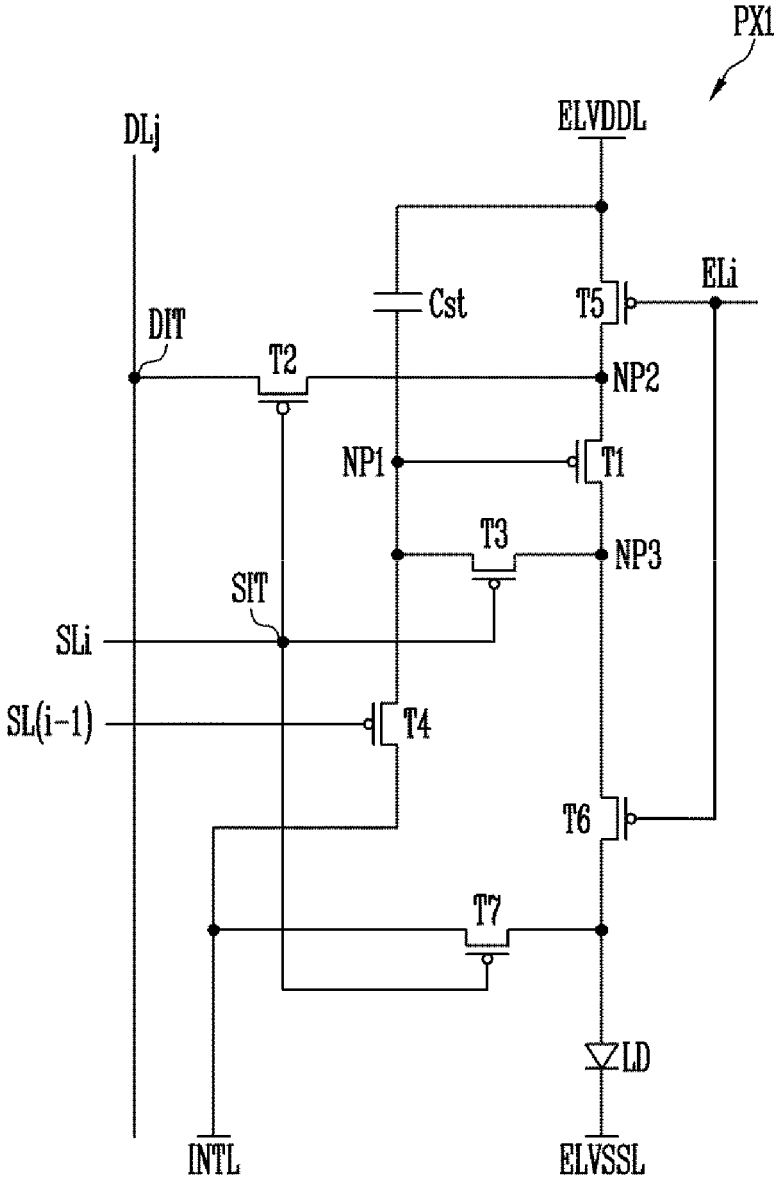
FIG. 2 is a diagram illustrating a pixel according to some example embodiments of the present disclosure.

FIG. 2 is a diagram illustrating the pixel according to some example embodiments of the present disclosure.

Referring to FIG. 2, the first pixel PX1 includes transistors T1, T2, T3, T4, T5, T6, and T7, a storage capacitor Cst, and a light emitting diode LD. Because the second pixel PX2 may have the same or similar configuration as the first pixel PX1 except for the connected scan lines SL(k−1) and SLk and the light emission line ELk, description on the second pixel PX2 is omitted. Because the third pixel PX3 may also have the same or similar configuration as the first pixel PX1 except for the scan lines SL(p−1) and SLp and the light emission line ELp, the third pixel PX3, description on the third pixel PX3 is omitted. In some embodiments, circuit configurations of the first pixel PX1, the second pixel PX2, and the third pixel PX3 may be different from each other.

Hereinafter, a circuit configured with a P-type transistor will be described as an example. However, those skilled in the art will be able to design a circuit configured with an N-type transistor by changing a polarity of a voltage applied to a gate terminal thereof. Similarly, those skilled in the art will be able to design a circuit configured with a combination of the P-type transistor and the N-type transistor. The P-type transistor is a generic term for a transistor in which the amount of current to be conducted increases when a voltage difference between a gate electrode and a source electrode thereof increases in a negative direction. The N-type transistor is a generic term for a transistor in which the amount of current to be conducted increases when a voltage difference between a gate electrode and a source electrode thereof increases in a positive direction. The transistor may be configured in various forms such as a thin film transistor (TFT), a field effect transistor (FET), and a bipolar junction transistor (BJT).

In the first transistor T1, a gate electrode thereof may be connected to a first node NP1, a first electrode thereof may be connected to a second node NP2, and a second electrode thereof may be connected to a third node NP3. The first transistor T1 may be referred to as a drive transistor.

In the second transistor T2, a gate electrode thereof may be connected to the i-th scan line SLi, a first electrode thereof may be connected to the data line DLj, and a second electrode thereof may be connected to the second node NP2. The second transistor T2 may be referred to as a scan transistor. The first electrode of the second transistor T2 may be a data input terminal DIT of the first pixel PX1. Further, the gate electrode of the second transistor T2 may be a scan input terminal SIT of the first pixel PX1.

In the third transistor T3, a gate electrode thereof may be connected to the i-th scan line SLi, a first electrode thereof may be connected to the first node NP1, and a second electrode thereof may be connected to the third node NP3. The third transistor T3 may be referred to as a diode-connected transistor.

In the fourth transistor T4, a gate electrode thereof may be connected to the i-th scan line SL(i−1), a first electrode thereof may be connected to the first node NP1, and the second electrode thereof may be connected to an initialization line INTL. In another embodiment, the gate electrode of the fourth transistor T4 may be connected to another scan line. The fourth transistor T4 may be referred to as a gate initialization transistor.

In the fifth transistor T5, a gate electrode thereof may be connected to the i-th light emission line ELi, a first electrode thereof may be connected to a first power line ELVDDL, and a second electrode thereof may be connected to the second node NP2. The fifth transistor T5 may be referred to as a light emitting transistor. According to some example embodiments, the gate electrode of the fifth transistor T5 may be connected to another light emission line.

In the sixth transistor T6, a gate electrode thereof may be connected to then i-th light emission line ELi, a first electrode thereof may be connected to the third node NP3, and a second electrode thereof may be connected to an anode of the light emitting diode LD. The sixth transistor T6 may be referred to as a light emitting transistor. In another embodiment, the gate electrode of the sixth transistor T6 may be connected to another light emission line.

In the seventh transistor T7, a gate electrode thereof may be connected to the i-th scan line SLi, a first electrode thereof may be connected to the initialization line INTL, and a second electrode thereof may be connected to the anode of the light emitting diode LD. The seventh transistor T7 may be referred to as a light emitting diode initialization transistor. According to some example embodiments, the gate electrode of the seventh transistor T7 may be connected to another scan line. For example, the gate electrode of the seventh transistor T7 may be connected to the (i+1)-th scan line.

A first electrode of the storage capacitor Cst may be connected to the first power line ELVDDL and a second electrode thereof may be connected to the first node NP1.

The light emitting diode LD may have the anode connected to the second electrode of the sixth transistor T6 and a cathode connected to the second power line ELVSSL. The light emitting diode LD may be configured by an organic light emitting diode, an inorganic light emitting diode, a quantum dot light emitting diode, or the like. Degradation of the first pixel PX1 may mean degradation of the light emitting diode LD.

A first power supply voltage may be applied to the first power supply line ELVDDL, a second power supply voltage may be applied to the second power supply line ELVSSL, and an initialization voltage may be applied to the initialization line INTL. For example, the first power supply voltage may be greater than the second power supply voltage. For example, the initialization voltage may be equal to or greater than the second power supply voltage. For example, the initialization voltage may correspond to the smallest data voltage of available data voltages. For example, a magnitude of the initialization voltage may be smaller than magnitudes of the available data voltages.

Figure 3:
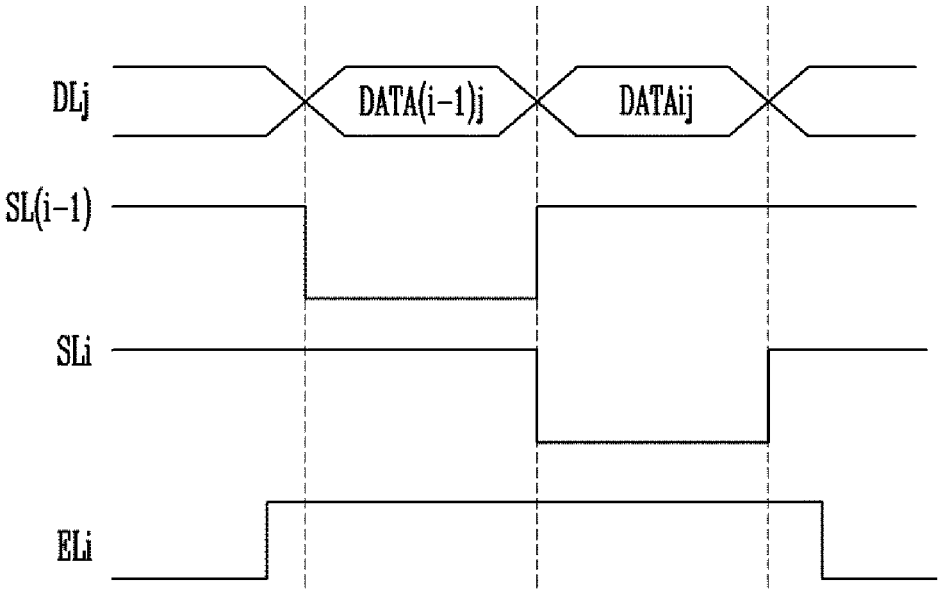
FIG. 3 is a diagram illustrating an example method of driving the pixel of FIG. 2.

FIG. 3 is a diagram illustrating an example method of driving the pixel of FIG. 2.

First, a data voltage DATA(i−1) j for the (i−1)-th pixel is applied to the data line DLj, and a scan signal of a turn-on level (logic low level) is applied to the (i−1)-th scan line SL(i−1).

At this time, because a scan signal of a turn-off level (logic high level) is applied to the i-th scan line SLi, the second transistor T2 is turned off, and the data voltage DATA(i−1)j for the (i−1)-the pixel is prevented from being input to the first pixel PX1.

At this time, because the fourth transistor T4 is in turned on, the first node NP1 is connected to the initialization line INTL, and a voltage of the first node NP1 is initialized. Because a light emission signal of a turn-off level is applied to the light emission line ELi, the transistors T5 and T6 are turned off, and instances of the light emitting diode LD unnecessarily emitting light during an initialization voltage application process may be prevented or reduced.

Next, a data voltage DATAij for the i-th first pixel PX1 is applied to the data line DLj, and a scan signal of a turn-on level is applied to the i-th scan line SLi. Accordingly, the transistors T2, T1, and T3 are turned on, and the data line DLj is electrically connected to the first node NP1. Thus, a compensation voltage obtained by subtracting a threshold voltage of the first transistor T1 from the data voltage DATAij is applied to the second electrode (that is, the first node NP1) of the storage capacitor Cst, and the storage capacitor Cst maintains a voltage corresponding to a difference between the first power supply voltage and the compensation voltage. This period may be referred to as a threshold voltage compensation period.

At this time, because the seventh transistor T7 is turned on, the anode of the light emitting diode LD is connected to the initialization line INTL, and the light emitting diode LD is initialized to the amount of charges corresponding to a voltage difference between the initialization voltage and the second power supply voltage.

Thereafter, as a light emission signal of a turn-on level is applied to the light emission line ELi, the transistors T5 and T6 may be turned on. Accordingly, a drive current path of the first power line ELVDDL, the fifth transistor T5, the first transistor T1, the sixth transistor T6, the light emitting diode LD, and the second power line ELVSSL is formed.

The amount of drive current flowing through the first and second electrodes of the first transistor T1 is adjusted according to the voltage maintained in the storage capacitor Cst. The light emitting diode LD emits light with a luminance corresponding to the amount of drive currents. The light emitting diode LD emits light until a light emission signal of a turn-off level is applied to the light emission line ELi.

Figure 4:
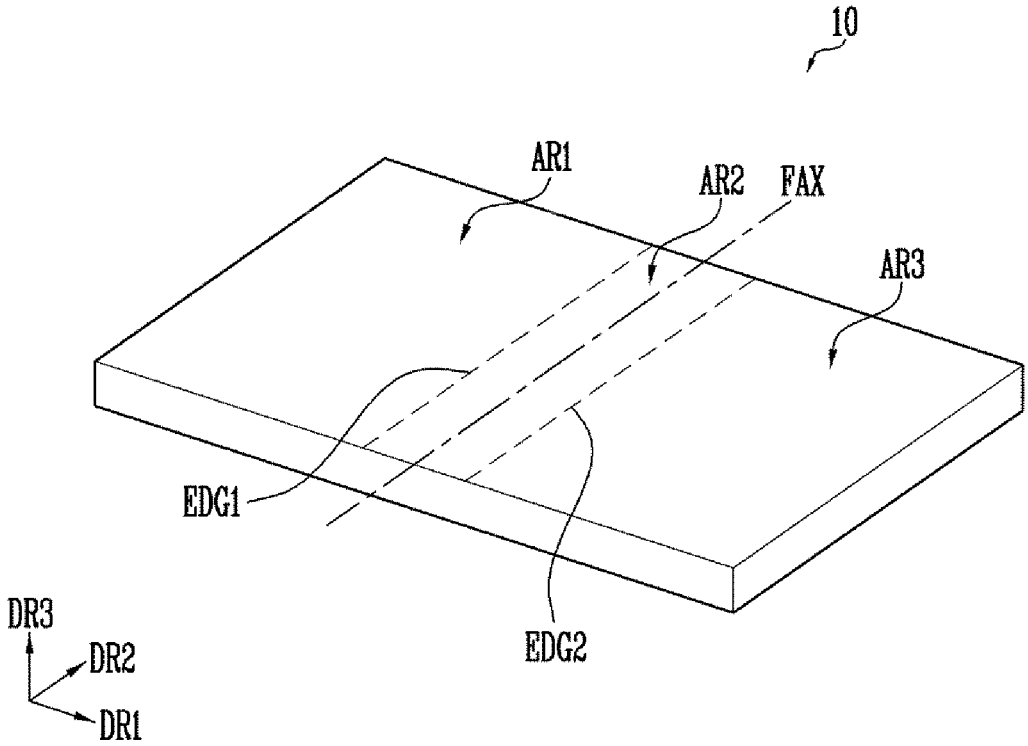
FIG. 4 is a diagram illustrating a case where a second pixel region is in an unfolded state.
Figure 5:
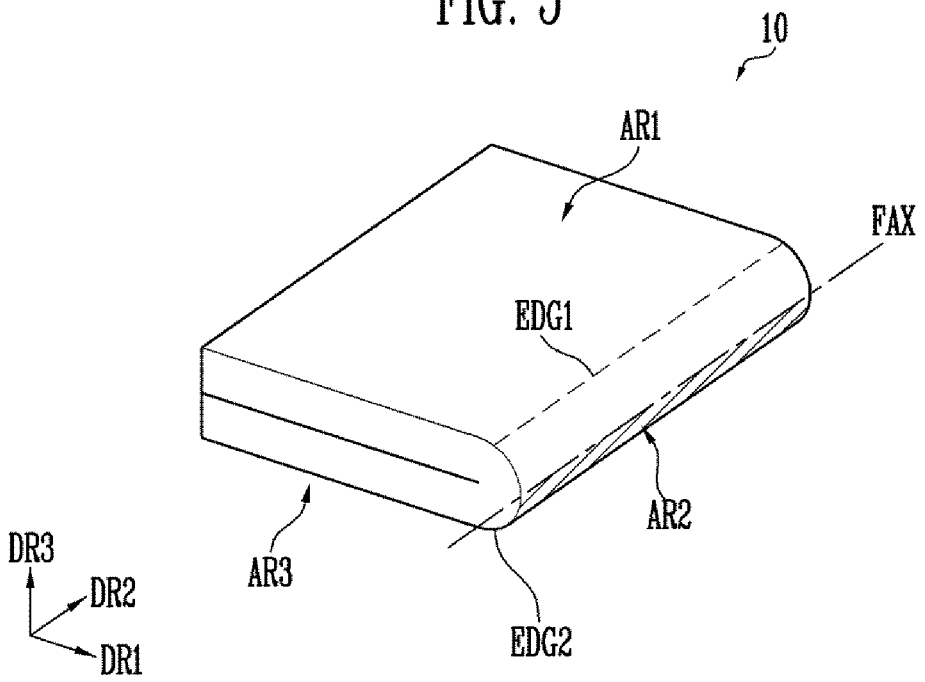
FIG. 5 is a diagram illustrating a case where the second pixel region is in a folded state.

FIG. 4 is a diagram illustrating a case in which the second pixel region is in an unfolded state, and FIG. 5 is a diagram illustrating a case in which the second pixel region is in a folded state.

As described above, the first pixel region AR1 and the second pixel region AR2 may come into contact with the first boundary EDG1, and the second pixel region AR2 and the third pixel region AR3 may come into contact with the second boundary EDG2.

Referring to FIG. 4, relative positional relationships between the pixel regions AR1, AR2, and AR3 may be defined based on the unfolded state of the display device 10. The second pixel region AR2 may be located in a first direction DR1 from the first pixel region AR1. The third pixel region AR3 may be located in the first direction DR1 from the second pixel region AR2. The first pixel region AR1, the second pixel region AR2, and the third pixel region AR3 may have a planar shape defined based on the first direction DR1 and a second direction DR2. At this time, a third direction DR3 may be an image display direction of the first pixel region AR1, the second pixel region AR2, and the third pixel region AR3. The first direction DR1, the second direction DR2, and the third direction DR3 may be perpendicular to each other. The first boundary EDG1, the second boundary EDG2, and the folding axis FAX may extend in the second direction DR2.

A configuration of the display device 10 described above may vary depending on the embodiment. For example, in a case of a circular display, unlike in FIG. 4, each of the pixel regions AR1, AR2, and AR3 may include a curved surface in the unfolded state.

In the unfolded state of the display device 10, all the pixel regions AR1, AR2, and AR3 may display images. At this time, the image displayed on the first pixel region AR1 and the image displayed on the second pixel region AR2 may be seamless at the first boundary ETG1. Further, the image displayed in the second pixel region AR2 and the image displayed in the third pixel region AR3 may be seamless at the second boundary EDG2. Seamlessness of the image at each of the boundaries EDG1 and EDG2 means that consecutive letters, figures, pictures, photos, videos, numbers, tones, colors, patterns, and the like may be expressed over each of the boundaries EDG1 and EDG2. For example, if a graphic, shape, or pattern extends from one region into another region across a boundary, the graphic, shape, or pattern is seamlessly displayed across the boundary and between the different regions if the graphic, shape, or pattern is not distorted and/or there is no perceptible visibility of the boundary line. Accordingly, it is possible to prevent the boundaries EDG1 and EDG2 from being recognized by a user.

In the unfolded state of the display device 10, all the pixel regions AR1, AR2, and AR3 may update an image at the same cycle. That is, drive frequencies of all the pixel regions AR1, AR2, and AR3 may be equal to each other.

Referring to FIG. 5, a case in which the second pixel region AR2 is folded is illustrated. The first pixel region AR1 exposed to a user may display an image, and the third pixel region AR3 not exposed to the user may not display an image or may display a black image.

The second pixels PX2 in contact with the first boundary EDG1 in the second pixel region AR2 may display an image. At this time, the second pixels PX2 in contact with the first boundary EDG1 may mean not only the second pixels PX2 directly configuring the first boundary EDG1 but also the second pixels PX2 of a first group located within a range (e.g., a set or predetermined range) from the first boundary EDG1. For example, the second pixels PX2 connected to the second scan lines except for the scan off lines which will be described below may belong to the first group.

The second pixels PX2 in contact with the second boundary EDG2 in the second pixel region AR2 may not display an image or may display a black image. At this time, the second pixels PX2 in contact with the second boundary EDG2 may mean not only the second pixels PX2 directly configuring the second boundary EDG2 but also the second pixel PX2 of a second group located within a range (e.g., a set predetermined range) from the second boundary EDG2. For example, the second pixels PX2 connected to the scan off lines which will be described below may belong to the second group.

The second pixels PX2 of the first group and the second pixels PX2 of the second group described above do not overlap each other. However, as will be described below, the number of scan off lines among the second scan lines may be changed, and at this time, the number of the second pixels PX2 of the first group and the second pixels PX2 of the second group may also be changed.

According to the present embodiment, an image displayed in the second pixel region AR2 may be scaled one or more times while the second pixel region AR2 maintains the folded state. At this time, the first pixel region AR1 may display an unscaled image. At this time, the image displayed in the first pixel region AR1 and the image displayed in the second pixel region AR2 may be seamless at the first boundary ETG1.

When the image displayed in the second pixel region AR2 is scaled, a boundary between the second pixels PX2 of the first group and the second pixels PX2 of the second group may be shifted in the second pixel region AR2. That is, a boundary between an image display region and an image non-display region (or black display region) may be shitted at a periodic or non-periodic time interval in the second pixel region AR2. Accordingly, a degree of degradation of the pixel in the second pixel region AR2 may be dispersed, and a user may be prevented from visually recognizing the boundary between the image display region and the image non-display region.

While the second pixel region AR2 maintains a folded state, the first pixel PX1 and the second pixel PX2 in contact with the first boundary EDG1 may update an image at a first cycle. At this time, the third pixel PX3 and the second pixel PX2 in contact with the second boundary EDG2 may update an image at a second cycle. At this time, the first cycle may be shorter than the second cycle. That is, the third pixel PX3 and the second pixel PX2 of the second group may be driven at a lower drive frequency than the first pixel PX1 and the second pixel PX2 of the first group. Because the third pixel PX3 and the second pixel PX2 of the second group display black images (or other still images) or do not display images, the images are not visually recognized as a defect by the user even if the drive frequency is lowered. Therefore, power consumption of the display device 10 may be reduced.

Figure 6:
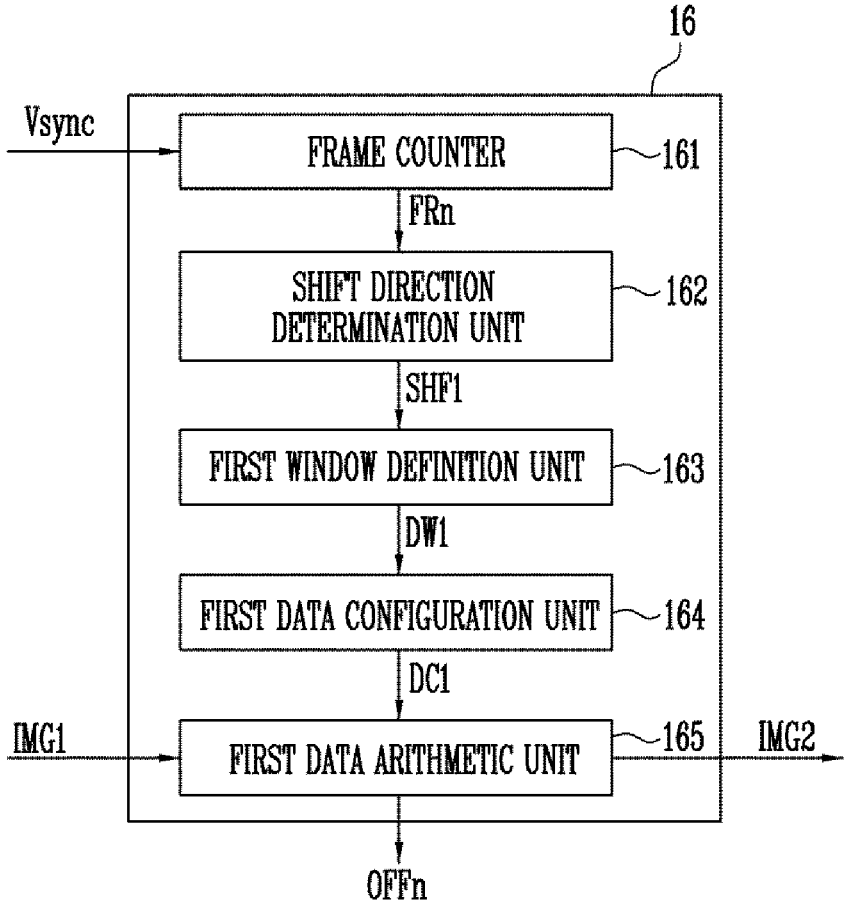
FIG. 6 is a diagram illustrating an image scaling unit according to some example embodiments of the present disclosure.
Figure 11:
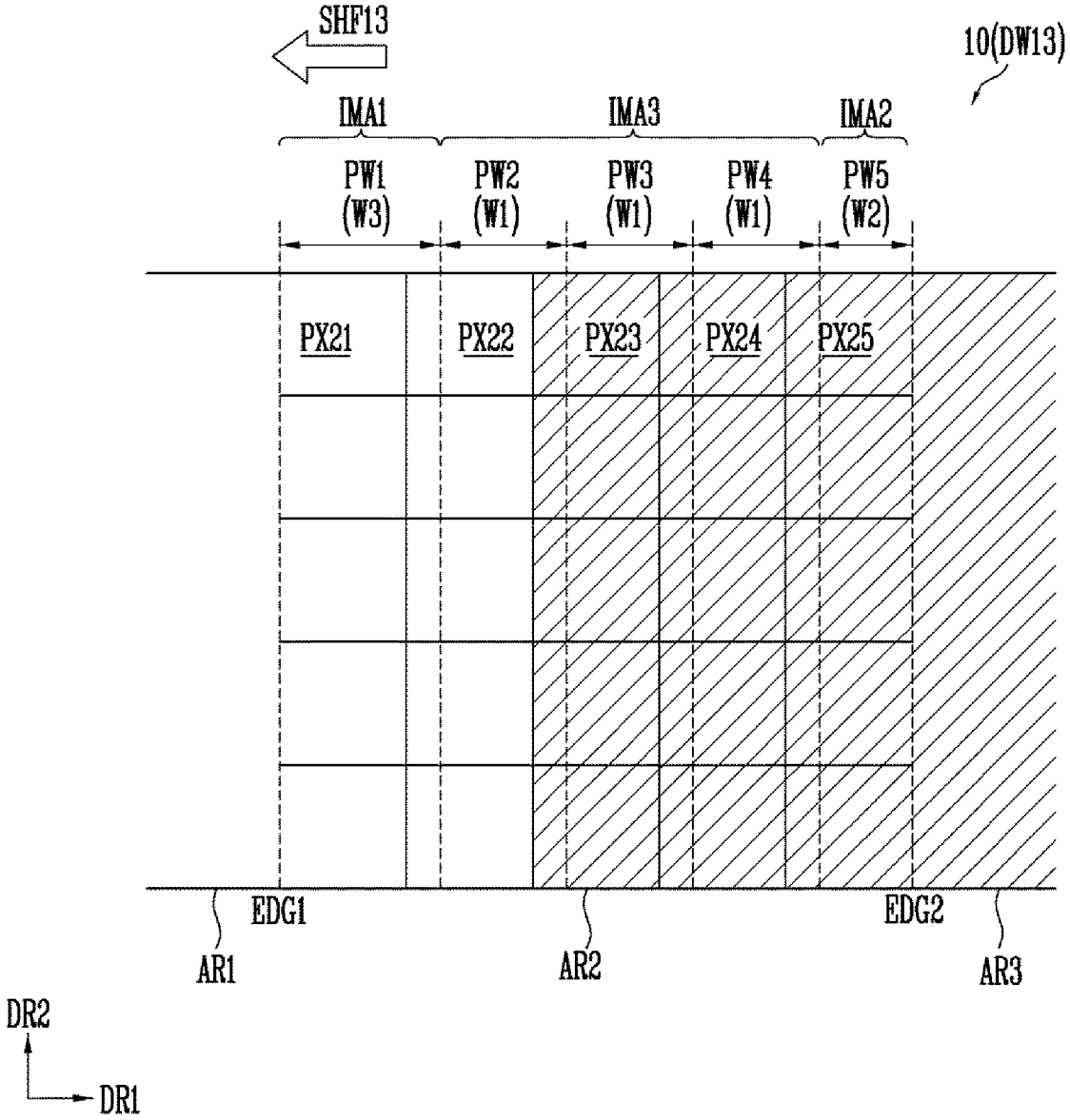
FIGS. 11 and 12 are diagrams illustrating the scaling method, according to some example embodiments of the present disclosure, for shifting the image in the second pixel region in a direction opposite to the first direction.
Figure 12:
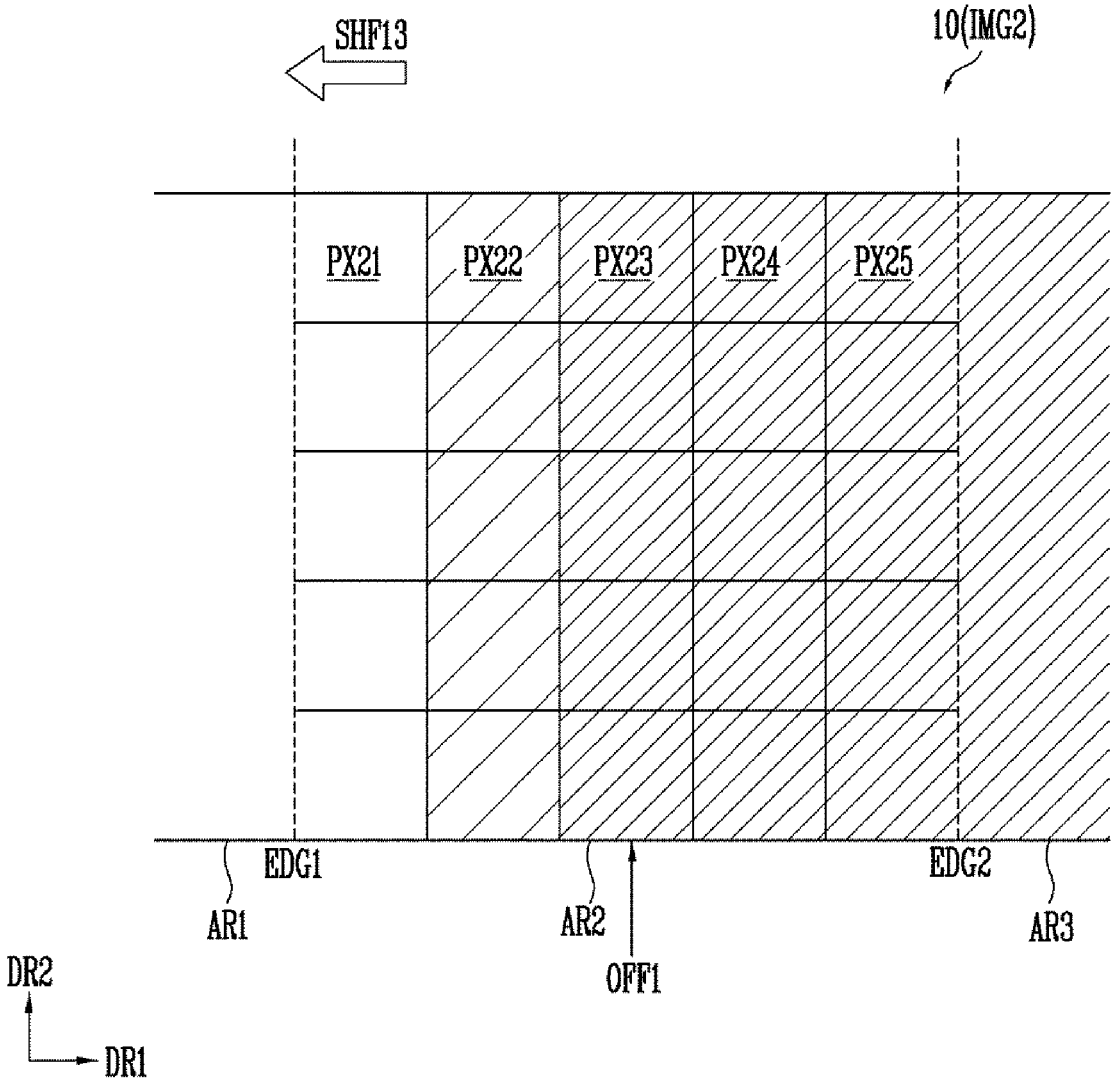

FIG. 6 is a diagram illustrating the image scaling unit according to the embodiment of the present disclosure. FIGS. 7 to 10 are diagrams illustrating a scaling method according to another embodiment of the present disclosure for shifting an image of a second pixel region in a first direction. FIGS. 11 and 12 are diagrams illustrating the scaling method according to another embodiment of the present disclosure for shifting the image of the second pixel region in a direction opposite to the first direction.

Referring to FIG. 6, the image scaling unit 16 according to the embodiment of the present disclosure may include a frame counter 161, a shift direction determination unit 162, a first window definition unit 163, and a first data configuration unit 164, and a first data arithmetic unit 165.

The frame counter 161 may check which frame a first image IMG1, which is a display target of the second pixel region AR2, corresponds to. For example, the frame counter 161 may output a frame number FRn of the target frame based on a vertical synchronization signal Vsync. The vertical synchronization signal Vsync may be a control signal indicating that data supply for the previous frame is ended and data supply for the current frame is started. For example, the vertical synchronization signal Vsync may have the form of a pulse, and a generation cycle of the pulse of the vertical synchronization signal Vsync may be the same as the cycle of the frame. Accordingly, the frame counter 161 may check the number of frames corresponding to the first image IMG1 by counting the pulses of the vertical synchronization signal Vsync.

Figure 7:
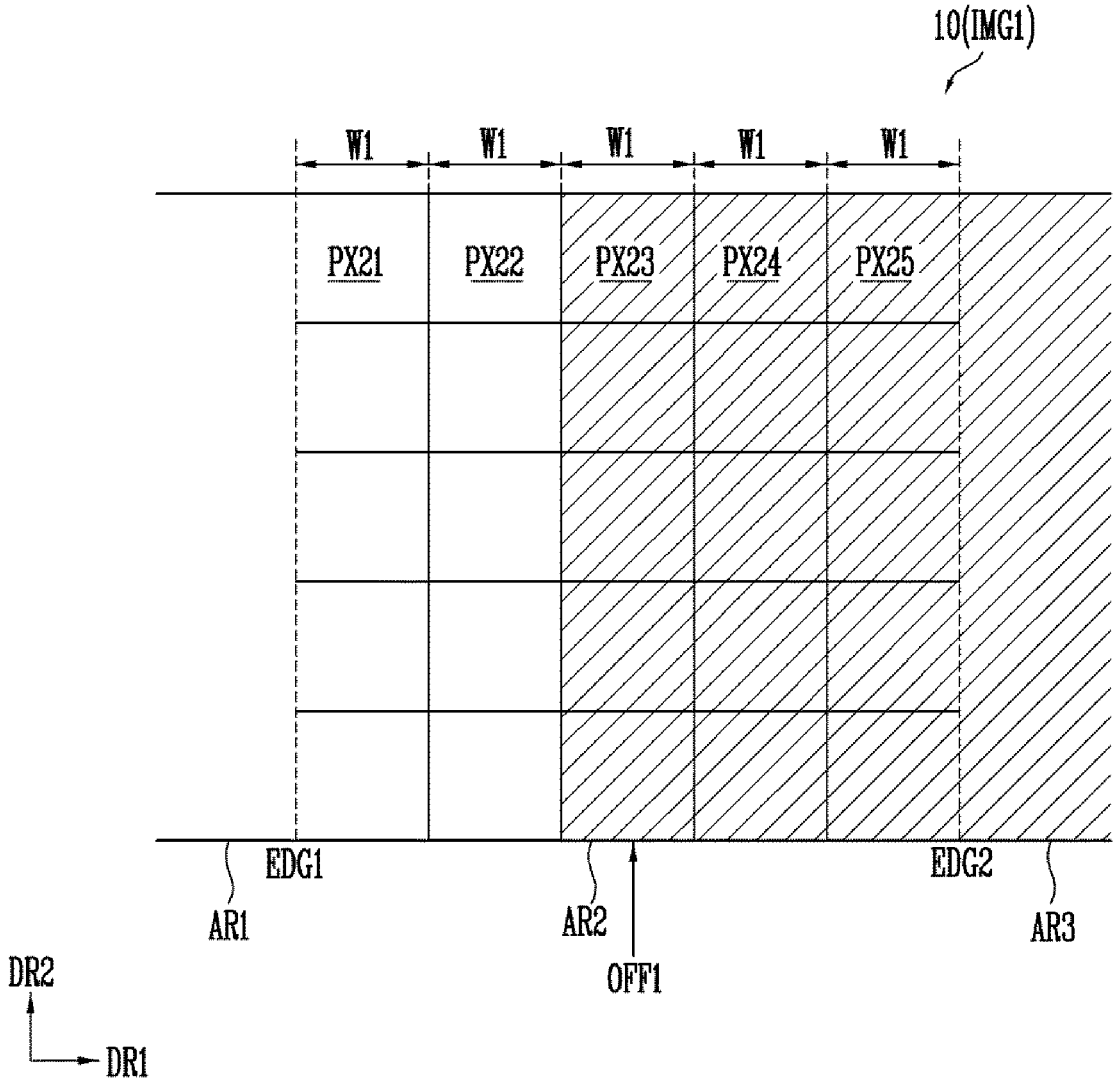
FIGS. 7 to 10 are diagrams illustrating a scaling method, according to some example embodiments of the present disclosure, for shifting an image in the second pixel region in a first direction.

Referring to FIG. 7, the display device 10 displaying the first image IMG1 in the folded state is illustrated as an example. For the sake of convenient description on comparison, it may be assumed that the display device 10 displays an image in a previous frame in FIG. 7. For example, an external processor may provide the grayscale values corresponding to the first image IMG1 during the previous frame period. Further, the external processor may provide once again the grayscale values corresponding to the first image IMG1 during the current frame period.

The second pixels PX21 and PX22 in contact with the first boundary EDG1 may display a seamless image and an image displayed in the first pixel region AR1. The second pixels PX23, PX24, and PX25 adjacent to the second boundary may display a black image or may not display an image. The third pixel region AR3 may display a black image or may not display an image.

Hereinafter, an area, a width, a length, and the like of each pixel relate to a light emitting region of a pixel, and do not relate to a pixel circuit. The area, the width, the length, and the like of the light emitting region of the pixel may vary depending on a color of the pixel. However, for the sake of convenient description, it is assumed that widths W1 of the second pixels PX21, PX22, PX23, PX24, and PX25 are all equal to each other. It is assumed that a width direction means the first direction DR1 and a length direction means the second direction DR2.

The shift direction determination unit 162 may determine a shift direction and a shift amount of the first image IMG1 and output first shift information SHF1. The first shift information SHF1 corresponding to the frame number FRn may be stored in a separate look-up-table (LUT) or the like.

The shift direction may be the first direction DR1 or a direction opposite to the first direction DR1. The shift amount may be smaller than the width W1 of one pixel. For example, the shift amount may correspond to approximately 1/32 of the pixel width W1. However, for the sake of convenient description, the shift amount may be somewhat exaggerated in FIGS. 7 to 12.

Figure 8:
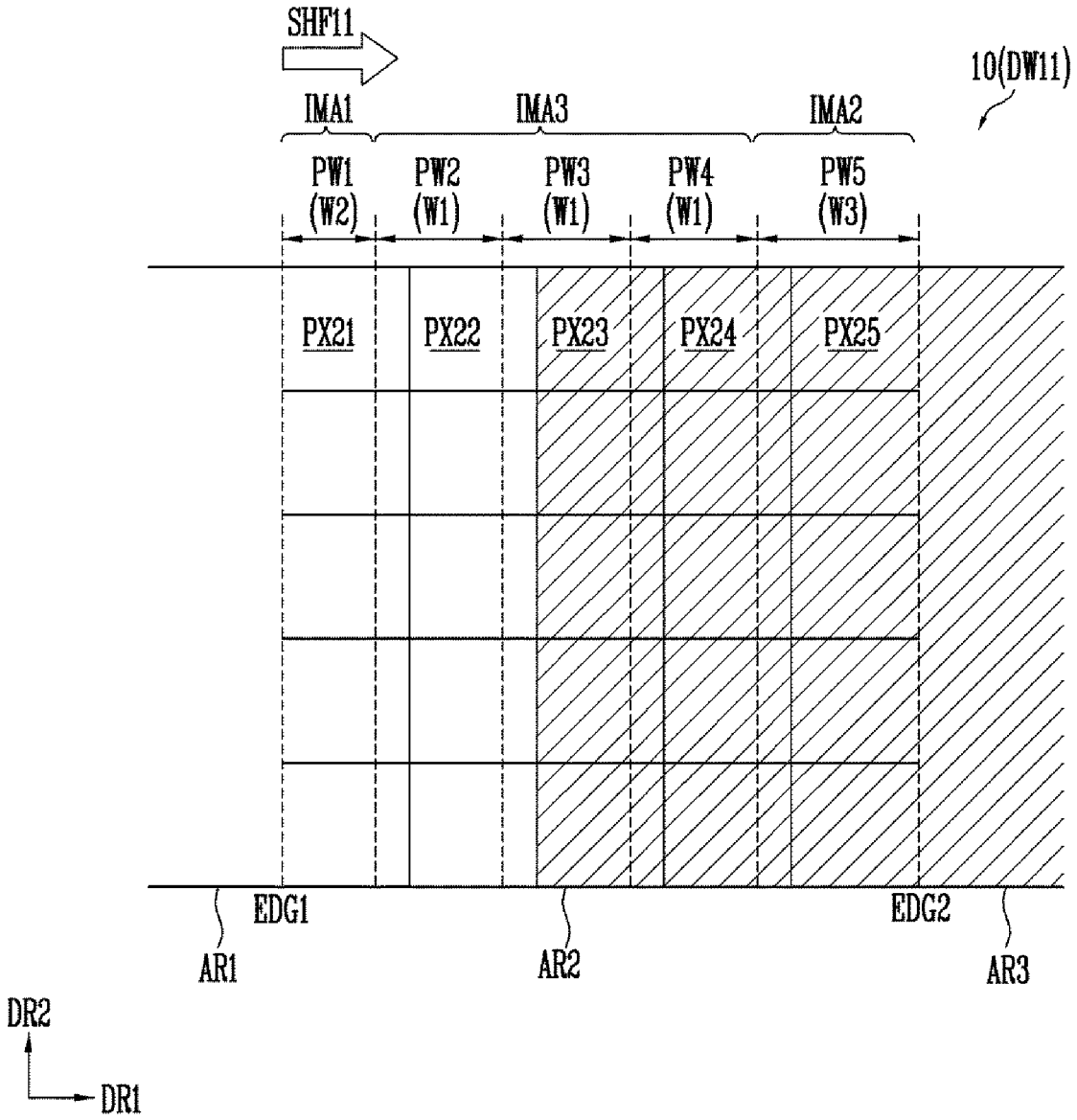
Figure 9:
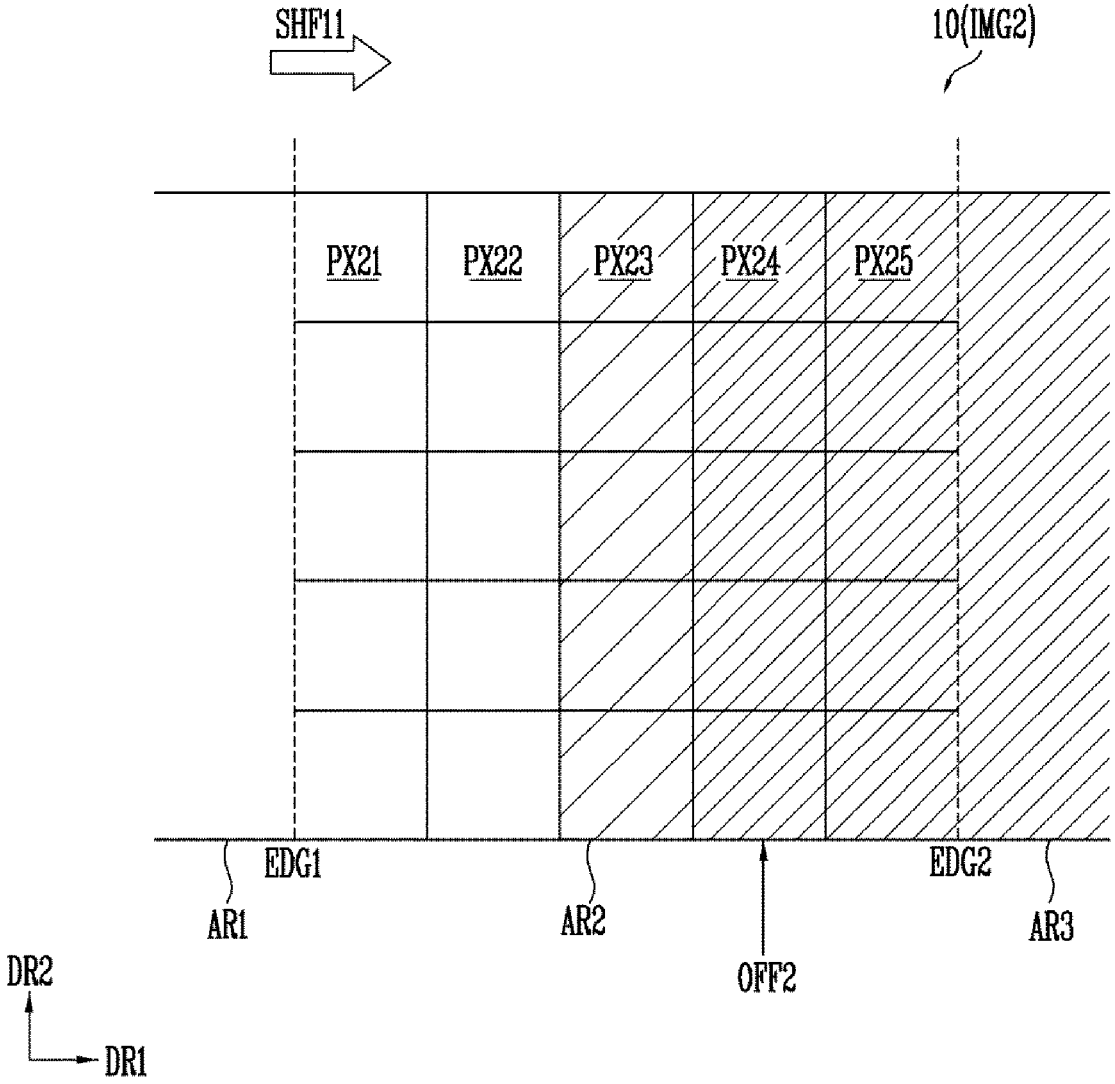

For example, in the embodiments of FIGS. 8 and 9, a shift direction of the first shift information SHF11 may be the first direction DR1, and the shift amount may be approximately 1/4 of the pixel width W1. For example, in the embodiment of FIG. 10, a shift direction of a first shift information SHF12 may be the first direction DR1, and the shift amount may be approximately 3/4 of the pixel width W1. For example, in the embodiments of FIGS. 11 and 12, a shift direction of a first shift information SHF13 is a direction opposite to the first direction DR1, and a shift amount may be approximately 1/4 of the pixel width W1.

The first window definition unit 163 may partition the first image IMG1 into a first image region IMA1, a second image region IMA2, and a third image region IMA3 based on the first shift information SHF1. The first image region IMA1 may be a region displayed in contact with the first boundary EDG1 in the first image IMG1. The second image region IMA2 may be a region displayed in contact with the second boundary EDG2 in the first image IMG1. The third image region IMA3 may be a region between the first image region IMA1 and the second image region IMA2.

The first window definition unit 163 may determine whether to designate the first image region as an up-scaling region or a down-scaling region according to the shift direction of the first shift information SHF1.

For example, as illustrated in the embodiments of FIGS. 8 and 9, when the first shift direction SHF11 is the first direction DR1, the first image region IMA1 may be designated as the up-scaling region. In this case, the second image region IMA2 may be designated as the down-scaling region. The third image region IMA3 may be a non-scaling region regardless of the first shift direction SHF1.

Figure 10:
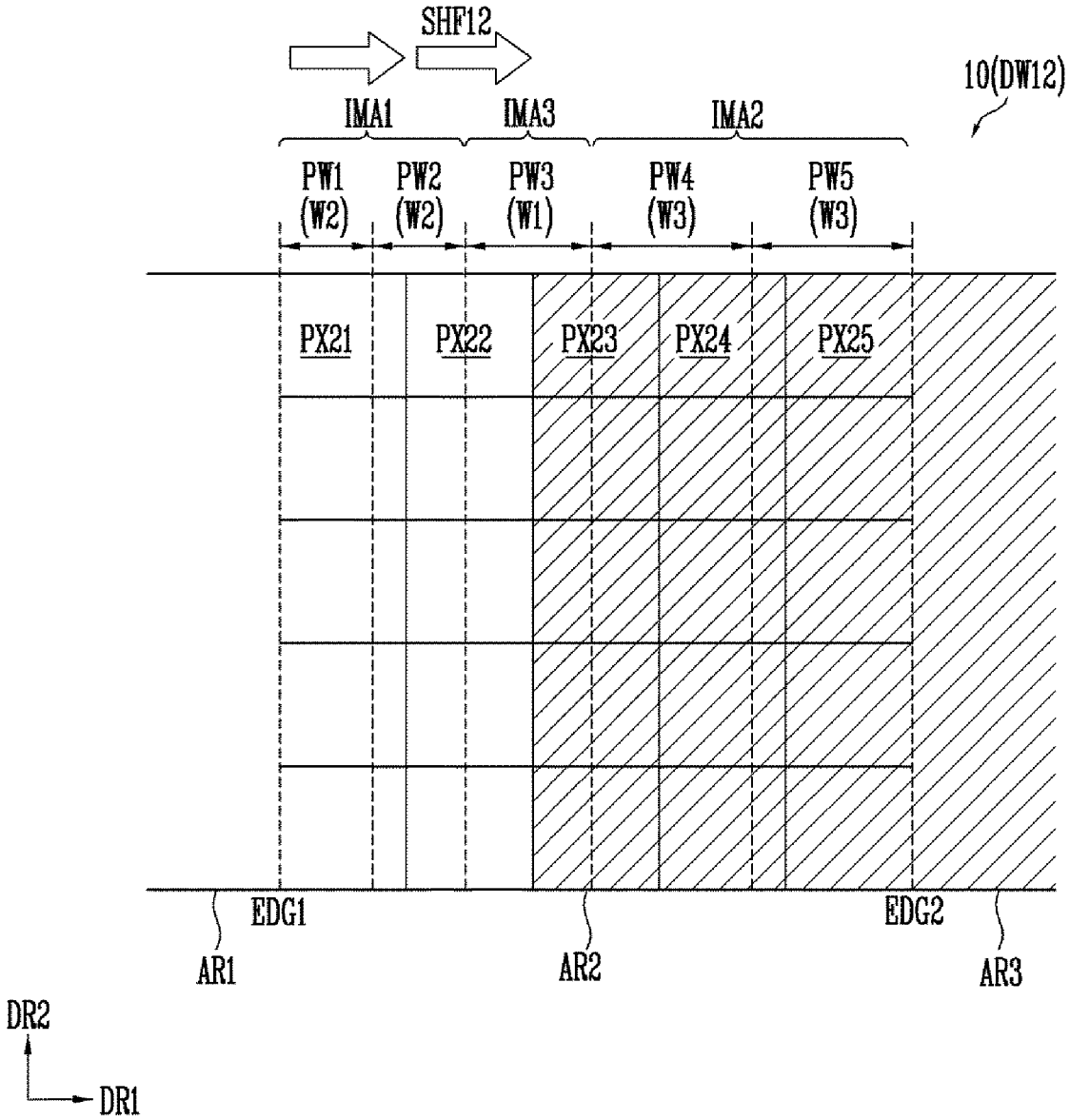

Further, in the embodiment of FIG. 10, because the shift direction of the first shift information SHF12 is the first direction DR1, the first image region IMA1 may be designated as the up-scaling region, the second image region IMA2 may be designated as the down-scaling region, and the third image region IMA3 may be a non-scaling region.

Meanwhile, as in the embodiments of FIGS. 11 and 12, when the shift direction of the first shift information SHF13 is a direction opposite to the first direction DR1, the first image region IMA1 may be designated as the down-scaling region, the second image region IMA2 may be designated as the up-scaling region, and the third image region IMA3 may be the non-scaling region.

Pixel windows PW1 to PW5 will be described based on the embodiments of FIGS. 8 and 9. The non-scaling region (third image region IMA3) may include pixel windows PW2, PW3, and PW4 having the same widths W1 as the widths W1 of the second pixels PX21 to PX25. The up-scaling region (first image region IMA1) may include the pixel window PW1 having a width W2 smaller than the widths W1 of the second pixels PX21 to PX25. The down-scaling region (second image region IMA2) may include a pixel window PW5 having a width W3 greater than the widths W1 of the second pixels PX21 to PX25.

The number of pixel windows PW1 to PW5 and the number of second pixels PX21 to PX25 may be equal to each other. The sum of the widths of the pixel windows PW1 to PW5 and the sum of the widths of the second pixels PX21 to PX25 may be equal to each other. The total area of the pixel windows PW1 to PW5 may be equal to the total area of the second pixels PX21 to PX25. For example, the pixel windows PW1 to PW5 may completely overlap the second pixels PX21 to PX25.

The first window definition unit 163 may determine a size of the first image region IMAG1 and a size of the second image region IMA2 depending on the shift amount of the first shift information SHF1. For example, as shift amount increases, the first image region IMA1 and the second image region IMA2 may be larger. Therefore, as the shift amount increases, the third image region IMA3 may be smaller.

The relatively large first image region IMA1 means that the number of pixel windows included in the first image region IMA1 is relatively large. For example, in the embodiments of FIGS. 8 and 9 in which the shift amount is relatively small, the first image region IMA1 may include five pixel windows PW1. For example, in the embodiment of FIG. 10 in which the shift amount is relatively large, the first image region IMA1 may include ten pixel windows PW1 and PW2.

The relatively large second image region IMA2 means that the number of pixel windows included in the second image region IMA2 is relatively large. For example, in the embodiment of FIGS. 8 and 9 in which the shift amount is relatively small, the second image region IMA2 may include five pixel windows PW5. For example, in the embodiment of FIG. 10 in which the shift amount is relatively large, the second image region IMA2 may include ten pixel windows PW4 and PW5.

The relatively small third image region IMA3 means that the number of pixel windows included in the third image region IMA3 is relatively small. For example, in the embodiments of FIGS. 8 and 9 in which the shift amount is relatively small, the third image region IMA3 may include 15 pixel windows PW2, PW2, and PW4. For example, in the embodiment of FIG. 10 in which the shift amount is relatively large, the third image region IMA3 may include five pixel windows PW3.

As such, the first window definition unit 163 may provide the pixel windows PW1 to PW5 with first window definition information DW11, based on the first shift information SHF1. For example, the first window definition information DW11 of FIG. 8 may indicate that each window row sequentially includes one pixel window PW1 having the width W2, three pixel windows PW2, PW3, and PW4 having the width W1, and one pixel window PW5 having the width W3 in the first direction DR1. For example, a first window definition information DW12 of FIG. 10 may indicate that each window row sequentially includes two pixel windows PW1 and PW2 having the width W2, one pixel window PW3 having the width W1, and two pixel windows PW4 and PW5 having the width W3 in the first direction DR1. For example, a first window definition information DW13 of FIG. 11 may indicate that each window row sequentially includes one pixel window PW1 having the width W3, three pixel windows PW2, PW3, and PW4 having the width W1, and one pixel window PW5 having the width W2 in the first direction DR1.

The first data configuration unit 164 may provide first data configuration information DC1 by determining a source image region corresponding to each of the pixel windows PW1 to PW5 based on the first window definition information DW1. At this time, the first data configuration unit 164 may be in a state where the first data configuration unit is not provided with specific grayscale values for each source image region.

Hereinafter, an operation of the first data configuration unit 164 will be described with reference to the embodiment of FIG. 8. It is assumed that the width W2 is ¾ of the width W1 and the width W3 is 5/4 of the width W1. The first data configuration information DC1 for the pixel window PW1 may be provided as in Equation 1 below.

$$DC1[PW1]=(GD[PX21]\times W2)/W2=GD[PX21] \quad \text{Equation 1}$$

Here, DC1[PW1] may be the first data configuration information DC1 for the pixel window PW1, and GD[PX21] may be a grayscale value of the second pixel PX21.

Similarly, the first data configuration information DC1 for the pixel window PW2 may be provided as in Equation 2 below.

$$DC1[PW2]=(GD[PX21]\times W1\times 1/4+GD[PX22]\times W1\times 3/4)/W1=GD[PX21]\times 1/4+GD[PX22]\times 3/4 \quad \text{Equation 1}$$

Here, DC1[PW2] may be the first data configuration information DC1 for the pixel window PW2, GD[PX21] may be a grayscale value of the second pixel PX21, and GD[PX22] may be a grayscale value of the second pixel PX22.

Similarly, the first data configuration information DC1 for the pixel window PW3 may be provided as in Equation 3 below.

$$DC1[PW3]=(GD[PX22]\times W1\times 1/4+GD[PX23]\times W1\times 3/4)/W1=GD[PX22]\times 1/4+GD[PX23]\times 3/4 \quad \text{Equation 3}$$

Here, DC1[PW3] may be the first data configuration information DC1 for the pixel window PW3, GD[PX22] may be a grayscale value of the second pixel PX22, and GD[PX23] may be a grayscale value of the second pixel PX23.

Similarly, the first data configuration information DC1 for the pixel window PW4 may be provided as in Equation 4 below.

$$DC1[PW4]=(GD[PX23]\times W1\times 1/4+GD[PX24]\times W1\times 3/4)/W1=GD[PX23]\times 1/4+GD[PX24]\times 3/4 \quad \text{Equation 4}$$

Here, DC1[PW4] may be the first data configuration information DC1 for the pixel window PW4, GD[PX23] may be a grayscale value of the second pixel PX23, and GD[PX24] may be a grayscale value of the second pixel PX24.

Similarly, the first data configuration information DC1 for the pixel window PW5 may be provided as in Equation 5 below.

$$DC1[PW5]=(GD[PX24]\times W1\times 1/4+GD[PX25]\times W1)/W3=GD[PX24]\times 1/5+GD[PX25]\times 4/5 \quad \text{Equation 5}$$

Here, DC1[PW5] may be the first data configuration information DC1 for the pixel window PW5, GD[PX24] may be a grayscale value of the second pixel PX24, and GD[PX25] may be a grayscale value of the second pixel PX25.

As such, information of the second pixels PX21 to PX25 overlapping the respective pixel windows PW1 to PW5 and information of weight corresponding to an overlapping ratio may be provided as the first data configuration information DC1.

The first data arithmetic unit 165 may generate a grayscale value of the second image IMG2 by inserting a grayscale value of the first image IMG1 into the first data configuration information DC1. Referring to FIG. 9, a case where the display device 10 displays the converted second image IMG2 is illustrated. DC1[PW1] of Equation 1 may become a converted grayscale value of the second pixel PX21. Similarly, DC1[PW2] of Equation 2 may become a converted grayscale value of the second pixel PX22. Similarly, DC1[PW3], DC1[PW4], and DC1[PW5] of Equations 3, 4, and 5 may become converted grayscale values of the second pixel PX23, the second pixel PX24, and the second pixel PX25, respectively.

It may be assumed a case where, in the first image IMG1, the second pixels PX23, PX24, and PX25 display black grayscales, and the second pixels PX21 and PX22 display white grayscales.

Referring to the second image IMG2 converted by the image scaling unit 16 according to the present embodiment, the second pixel PX23 has a grayscale lighter than a black grayscale and darker than a white grayscale, and thereby, there is an effect that an image displayed in the second pixel region AR2 is shifted in the first direction DR1. For example, as the first image region IMA1 and the second image region IMA2 increase, a display region of the second pixel region AR2 increases and a non-display region (or a black display region) decreases. If the shift amount is large enough, the second pixel PX23 may display the white grayscale.

Referring to FIGS. 11 and 12, there is an effect that the image displayed in the second pixel region AR2 is shifted in a direction opposite to the first direction DR1. For example, as the first image region IMA1 and the second image region IMA2 increase, the display region of the second pixel region AR2 decreases and the non-display region (or the black display region) increases. If the shift amount is large enough, the second pixel PX22 may display a black grayscale.

Accordingly, even if an external processor provides the same first image IMG1 in consecutive frames, a degree of degradation of the second pixel PX2 may be dispersed in the second pixel region AR2, and a user may be prevented from visually recognizing a boundary between the image display region and the image non-display region.

Additionally, the first data arithmetic unit 165 may provide the scan off line number OFFn based on the grayscale value of the second image IMG2. For example, the scan off line number OFFn may be the smallest number of the numbers of the consecutive scan lines when the grayscale values of the second pixels PX2 connected to the continuous scan lines are all black grayscale values. For example, in FIGS. 7 and 12, a number OFF1 of the scan line connected to the second pixel PX23 may be the scan off line number OFFn. For example, in FIG. 9, a number OFF2 of the scan line connected to the second pixel PX24 may be the scan off line number OFFn.

Depending on the embodiment, a margin value may be added to the scan off line number OFFn. For example, when the margin value is 1, the number of the scan line connected to the second pixel PX24 may be the scan off line number OFFn in FIGS. 7 and 12. For example, in FIG. 9, the number of the scan line connected to the second pixel PX25 may be the scan off line number OFFn. The margin value may be appropriately selected within a range in which a display defect does not appear according to a specification of the display device 10.

Figure 13:
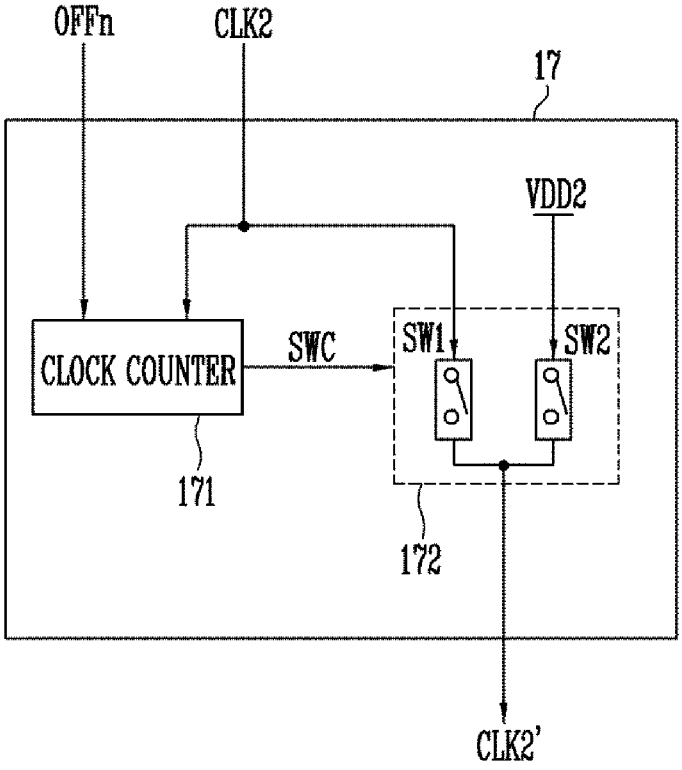
FIG. 13 is a diagram illustrating a scan off unit according to some example embodiments of the present disclosure.

FIG. 13 is a diagram illustrating a scan off unit according to the embodiment of the present disclosure.

Referring to FIG. 13, the scan off unit 17 according to the embodiment of the present disclosure may include a clock counter 171 and a multiplexer 172.

The clock counter 171 may increase a count value by counting pulses of a clock signal CLK2, and may turn on a first switch SW1 and turn off a second switch SW2 in response to a control signal SWC at a point of time when a counted value corresponds to the scan off line number OFFn.

The multiplexer 172 may include the first switch SW1 and the second switch SW2. The multiplexer 172 may output the clock signal CLK2 as a second clock signal CLK2' when the first switch SW1 is turned on. The multiplexer 172 may output a second high voltage VDD2 as the second clock signal CLK2' when the second switch SW2 is turned on.

In the embodiment of FIG. 13 and the following embodiments, it is described that the scan off unit 17 adjusts the second clock signal CLK2', but in another embodiment, the scan off unit 17 may be configured to adjust the first clock signal. In still another embodiment, the scan off unit 17 may be configured to adjust both the first clock signal and the second clock signal CLK2'.

FIGS. 14 to 18 are diagrams illustrating an example operation of the scan off unit.

Figure 14:
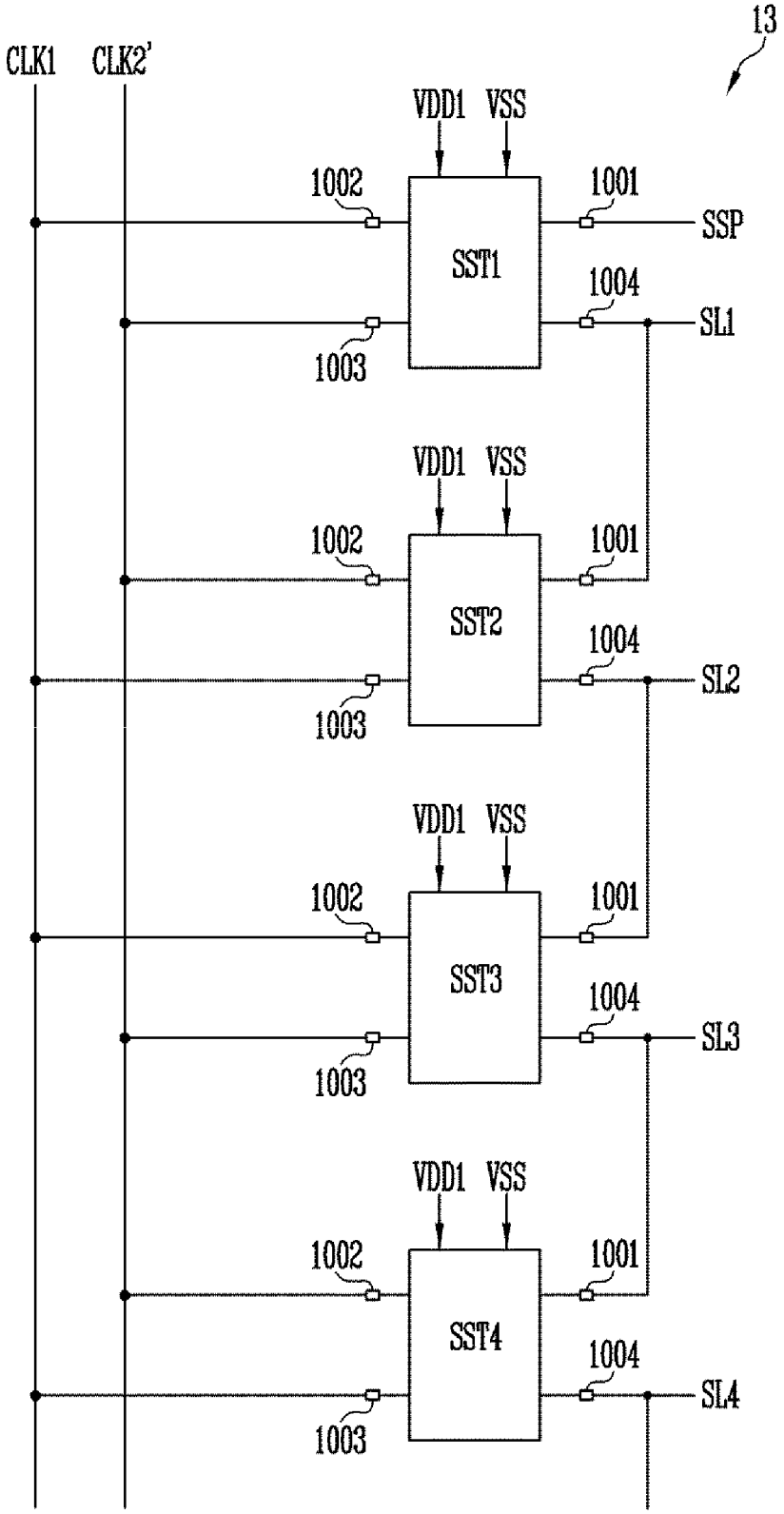
FIGS. 14 to 18 are diagrams illustrating an example operation of the scan off unit.

Referring to FIG. 14, the scan drive unit 13 according to the embodiment of the present disclosure may include a plurality of scan stages SST1 to SST4. Each of the scan stages SST1 to SST4 is connected to one of the scan lines SL1 to SL4 and is driven in response to the clock signals CLK1 and CLK2'. The scan stages SST1 to SST4 may be realized by the same circuit.

Each of the scan stages SST1 to SST4 includes a first input terminal 1001, a second input terminal 1002, a third input terminal 1003, and an output terminal 1004.

The first input terminal 1001 of each of the scan stages SST1 to SST4 receives an output signal (that is, a scan signal) or a scan start signal SSP of the previous scan stage. For example, the first input terminal 1001 of the first scan stage SST1 receives the scan start signal SSP, and the first input terminals 1001 of the remaining scan stages SST2 to SST4 receive output signals of the previous stages.

The second input terminal 1002 of the j-th (j is an odd number or an even number) scan stage SSTj receives the first clock signal CLK1, and the third input terminal 1003 receives the second clock signal CLK2'. The second input terminal 1002 of the (j+1)-th scan stage SSTj+1 receives the second clock signal CLK2' and the third input terminal 1003 thereof receives the first clock signal CLK1.

The first clock signal CLK1 and the second clock signal CLK2' have the same cycle and phases thereof do not overlap each other. For example, when a period in which the scan signal is supplied to one scan line is referred to as one horizontal period 1H, each of the clock signals CLK1 and CLK2 has a cycle of 2H and are supplied in different horizontal periods.

Further, each of the scan stages SST1 to SST4 receives a first high voltage VDD1 and a low voltage VSS. Here, the first high voltage VDD1 may be set as a gate-off voltage, for example, a logic high voltage. In addition, the low voltage VSS may be set as a gate-on voltage, for example, a logic low voltage.

Figure 15:
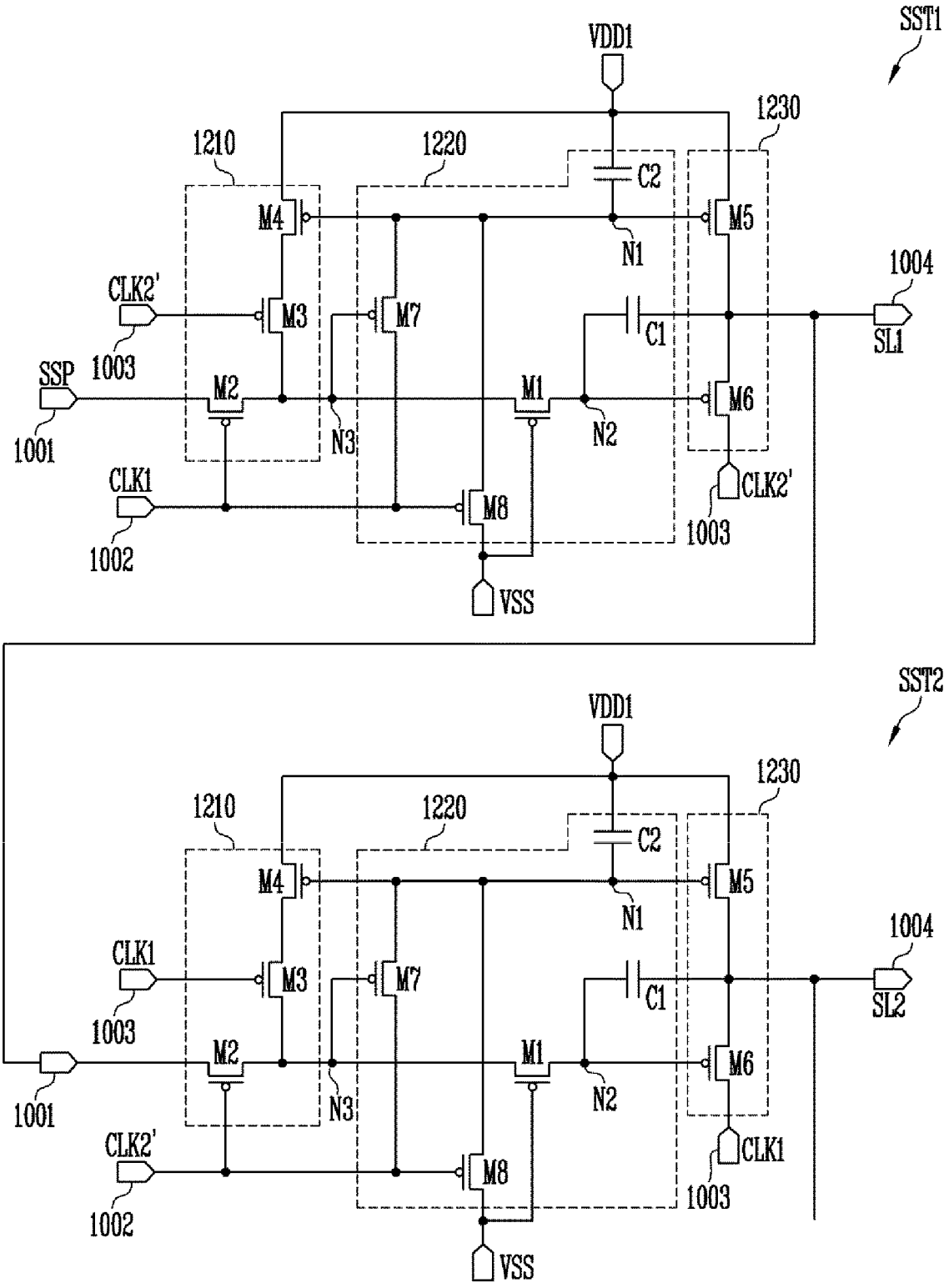

FIG. 15 is a circuit diagram illustrating an example of the scan stage illustrated in FIG. 14. In FIG. 15, the first scan stage SST1 and the second scan stage SST2 are illustrated for the sake of convenient description.

Referring to FIG. 15, the first scan stage SST1 according to the embodiment of the present disclosure includes a first drive unit 1210, a second drive unit 1220, an output unit 1230 (or a buffer), and a first transistor M1.

The output unit 1230 controls a voltage supplied to the output terminal 1004 in response to voltages of a first node N1 and a second node N2. To this end, the output unit 1230 includes a fifth transistor M5 and a sixth transistor M6.

The fifth transistor M5 is located between the first high voltage VDD1 and the output terminal 1004, and a gate electrode thereof is connected to the first node N1. The fifth transistor M5 controls a connection between the first high voltage VDD1 and the output terminal 1004 in response to a voltage applied to the first node N1.

The sixth transistor M6 is located between the output terminal 1004 and the third input terminal 1003, and a gate electrode thereof is connected to the second node N2. The sixth transistor M6 controls a connection between the output terminal 1004 and the third input terminal 1003 in response to a voltage applied to the second node N2. The output unit 1230 operates as a buffer. Additionally, the fifth transistor M5 and/or the sixth transistor M6 may be configured by a plurality of transistors connected in parallel.

The first drive unit 1210 controls a voltage of the third node N3 in response to signals supplied to the first input terminal 1001 to the third input terminal 1003. To this end, the first drive unit 1210 includes second transistors M2 to M4.

The second transistor M2 is located between the first input terminal 1001 and the third node N3, and a gate electrode thereof is connected to the second input terminal 1002. The second transistor M2 controls a connection between the first input terminal 1001 and the third node N3 in response to a signal supplied to the second input terminal 1002.

The third transistor M3 and the fourth transistor M4 are connected in series between the third node N3 and the first high voltage VDD1. Actually, the third transistor M3 is located between the fourth transistor M4 and the third node N3, and a gate electrode thereof is connected to the third input terminal 1003. The third transistor M3 controls a connection between the fourth transistor M4 and the third node N3 in response to a signal supplied to the third input terminal 1003.

The fourth transistor M4 is located between the third transistor M3 and the first high voltage VDD1, and a gate electrode thereof is connected to the first node N1. The fourth transistor M4 controls a connection between the third transistor M3 and the first high voltage VDD1 in response to a voltage of the first node N1.

The second drive unit 1220 controls the voltage of the first node N1 in response to voltages of the second input terminal 1002 and the third node N3. To this end, the second drive unit 1220 includes a seventh transistor M7, an eighth transistor M8, a first capacitor C1, and a second capacitor C2.

The first capacitor C1 is connected between the second node N2 and the output terminal 1004. The first capacitor C1 charges a voltage corresponding to turn-on and turn-off of the sixth transistor M6.

The second capacitor C2 is connected between the first node N1 and the first high voltage VDD1. The second capacitor C2 charges a voltage applied to the first node N1.

The seventh transistor M7 is located between the first node N1 and the second input terminal 1002, and a gate electrode thereof is connected to the third node N3. The seventh transistor M7 controls a connection between the first node N1 and the second input terminal 1002 in response to a voltage of the third node N3.

The eighth transistor M8 is located between the first node N1 and the low voltage VSS, and a gate electrode thereof is connected to the second input terminal 1002. The eighth transistor M8 controls a connection between the first node N1 and the low voltage VSS in response to a signal of the second input terminal 1002.

The first transistor M1 is located between the third node N3 and the second node N2, and the gate electrode thereof is connected to the low voltage VSS. The first transistor M1 maintains an electrical connection between the third node N3 and the second node N2 while maintaining a turn-on state. Additionally, the first transistor M1 limits a voltage drop width of the third node N3 in response to a voltage of the second node N2. In other words, even if the voltage of the second node N2 drops to a voltage lower than the low voltage VSS, the voltage of the third node N3 does not drop to a voltage lower than a voltage obtained by subtracting a threshold voltage of the first transistor M1 from the low voltage VSS. Detailed description thereof will be made below.

Figure 16:
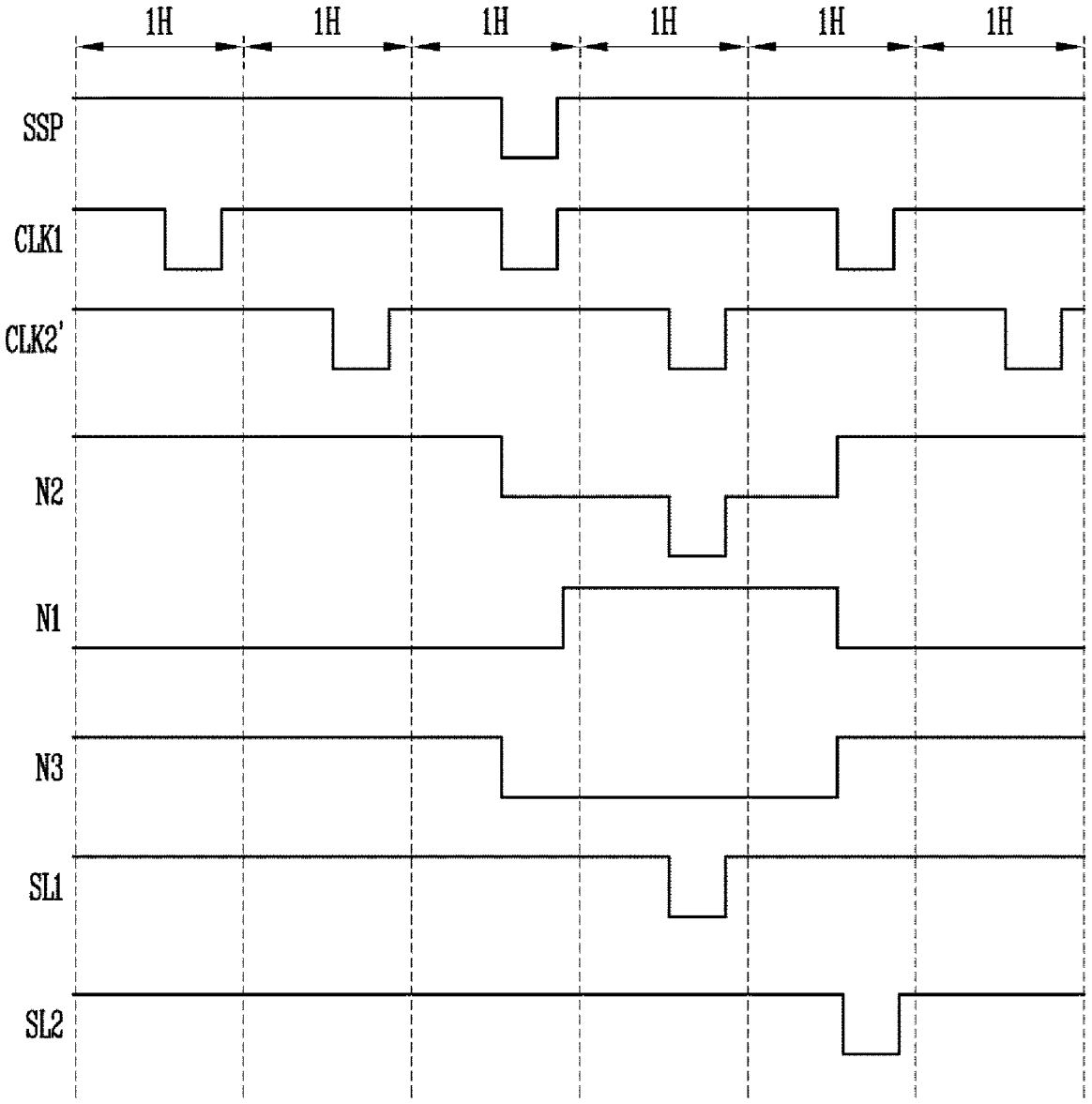

FIG. 16 is a waveform diagram illustrating an embodiment of a method of driving the scan stage illustrated in FIG. 15. In FIG. 16, an operation process will be described by using the first scan stage SST1 for the sake of convenient description.

Referring to FIG. 16, the first clock signal CLK1 and the second clock signal CLK2' have a cycle of two horizontal periods 2H and are supplied in different horizontal periods. In other words, the second clock signal CLK2' is set to a signal shifted by a half period (that is, one horizontal period) from the first clock signal CLK1. In addition, the scan start signal SSP supplied to the first input terminal 1001 is supplied to be synchronized with the clock signal supplied to the second input terminal 1002, that is, the first clock signal CLK1.

Additionally, when the scan start signal SSP is supplied, the first input terminal 1001 may be set to the low voltage VSS, and when the scan start signal SSP is not supplied, the first input terminal 1001 may be set to the high voltage VDD1. In addition, when the clock signal CLK is supplied to the second input terminal 1002 and the third input terminal 1003, the second input terminal 1002 and the third input terminal 1003 may be set the low voltage VSS, and when the clock signal CLK is not set, the second input terminal 1002 and the third input terminal 1003 may be set to the first high voltage VDD1.

In detail, the scan start signal SSP is supplied to be synchronized with the first clock signal CLK1.

When the first clock signal CLK1 is supplied, the second transistor M2 and the eighth transistor M8 are turned on. When the second transistor M2 is turned on, the first input terminal 1001 is electrically connected to the third node N3. Here, because the first transistor M1 is always set to a turn-on state, an electrical connection between the second node N2 and the third node N3 is maintained.

When the first input terminal 1001 is electrically connected to the third node N3, the third node N3 and the second node N2 are set to a low voltage by the scan start signal SSP supplied to the first input terminal 1001. If the third node N3 and the second node N2 are set to the low voltage, the sixth transistor M6 and the seventh transistor M7 are turned on.

When the sixth transistor M6 is turned on, the third input terminal 1003 is electrically connected to the output terminal 1004. Here, the third input terminal 1003 is set to a high voltage (that is, the second clock signal CLK2' is not supplied), and thereby, the high voltage is also output to the output terminal 1004. When the seventh transistor M7 is turned on, the second input terminal 1002 is electrically connected to the first node N1. Then, a voltage of the first clock signal CLK1, that is, a low voltage, supplied to the second input terminal 1002 is supplied to the first node N1.

Additionally, when the first clock signal CLK1 is supplied, the eighth transistor M8 is turned on. When the eighth transistor M8 is turned on, the low voltage VSS is supplied to the first node N1. Here, the low voltage VSS is set to the same (or similar) voltage as the first clock signal CLK1, and thereby, the first node N1 maintains the low voltage stably.

When the first node N1 is set to the low voltage, the fourth transistor M4 and the fifth transistor M5 are turned on. If the fourth transistor M4 is turned on, the first high voltage VDD1 is electrically connected to the third transistor M3. Here, because the third transistor M3 is set to a turn-off state, the third node N3 stably maintains the low voltage even if the fourth transistor M4 is turned on. If the fifth transistor M5 is turned on, the first high voltage VDD1 is supplied to the output terminal 1004. Here, the first high voltage VDD1 is set to the same voltage as a high voltage supplied to the third input terminal 1003, and thereby, the output terminal 1004 stably maintains the high voltage.

Thereafter, a supply of the scan start signal SSP and the first clock signal CLK1 stops. If the supply of the first clock signal CLK1 stops, the second transistor M2 and the eighth transistor M8 are turned off. At this time, the sixth transistor M6 and the seventh transistor M7 maintain the turn-on state in response to a voltage stored in the first capacitor C1. That is, the second node N2 and the third node N3 maintain the low voltage due to the voltage stored in the first capacitor C1.

When the sixth transistor M6 maintains the turn-on state, the electrical connection between the output terminal 1004 and the third input terminal 1003 is maintained. When the seventh transistor M7 maintains the turn-on state, the electrical connection between the first node N1 and the second input terminal 1002 is maintained. Here, a voltage of the second input terminal 1002 is set to the high voltage in response to the supply stop of the first clock signal CLK1, and thereby, the first node N1 is also set to the high voltage. If the high voltage is supplied to the first node N1, the fourth transistor M4 and the fifth transistor M5 are turned off.

Thereafter, the second clock signal CLK2' is supplied to the third input terminal 1003. At this time, because the sixth transistor M6 is set to the turn-on state, the second clock signal CLK2' supplied to the third input terminal 1003 is supplied to the output terminal 1004. In this case, the output terminal 1004 outputs the second clock signal CLK2' to the first scan line SL1 as a scan signal.

Meanwhile, when the second clock signal CLK2' is supplied to the output terminal 1004, the voltage of the second node N2 drop to a voltage lower than the low voltage VSS due to coupling of the first capacitor C1, and thereby, the sixth transistor M6 stably maintains the turn-on state.

On the other hand, even if the voltage of the second node N2 drops, a voltage of the third node N3 is maintained as approximately the low voltage VSS (for example, a voltage obtained by subtracting a threshold voltage of the first transistor M1 from the low voltage VSS) by the first transistor M1.

After the scan signal is output to the first scan line SL1, a supply of the second clock signal CLK2' stops. If the supply of the second clock signal CLK2' stops, the output terminal 1004 outputs the high voltage. Further, the voltage of the second node N2 rises to approximately the low voltage VSS in response to the high voltage of the output terminal 1004.

Thereafter, the first clock signal CLK1 is supplied. If the first clock signal CLK1 is supplied, the second transistor M2 and the eighth transistor M8 are turned on. If the second transistor M2 is turned on, the first input terminal 1001 is electrically connected to the third node N3. At this time, the first input terminal 1001 is not supplied with the scan start signal SSP, thereby, being set to the high voltage. Therefore, if the first transistor M1 is turned on, the high voltage is supplied to the third node N3 and the second node N2, and thereby, the sixth transistor M6 and the seventh transistor M7 are turned off.

If the eighth transistor M8 is turned on, the low voltage VSS is supplied to the first node N1, and thereby, the fourth transistor M4 and the fifth transistor M5 are turned on. If the fifth transistor M5 is turned on, the high voltage VDD1 is supplied to the output terminal 1004. Thereafter, the fourth transistor M4 and the fifth transistor M5 maintain a turn-on state in response to the voltage charged in the second capacitor C2, and thereby, the output terminal 1004 is stably supplied with the first high voltage VDD1.

Additionally, when the second clock signal CLK2' is supplied, the third transistor M3 is turned on. At this time, because the fourth transistor M4 is set to the turn-on state, the first high voltage VDD1 is supplied to the third node N3 and the second node N2. In this case, the sixth transistor M6 and the seventh transistor M7 stably maintain the turn-off state.

The second scan stage SST2 receives an output signal (that is, a scan signal) of the first scan stage SST1 so as to be synchronized with the second clock signal CLK2'. In this case, the second scan stage SST2 outputs the scan signal to the second scan line SL2 so as to be synchronized with the first clock signal CLK1. The scan stages SST1 to SST4 sequentially output the scan signals to the scan lines while repeating the above-described process.

Figure 17:
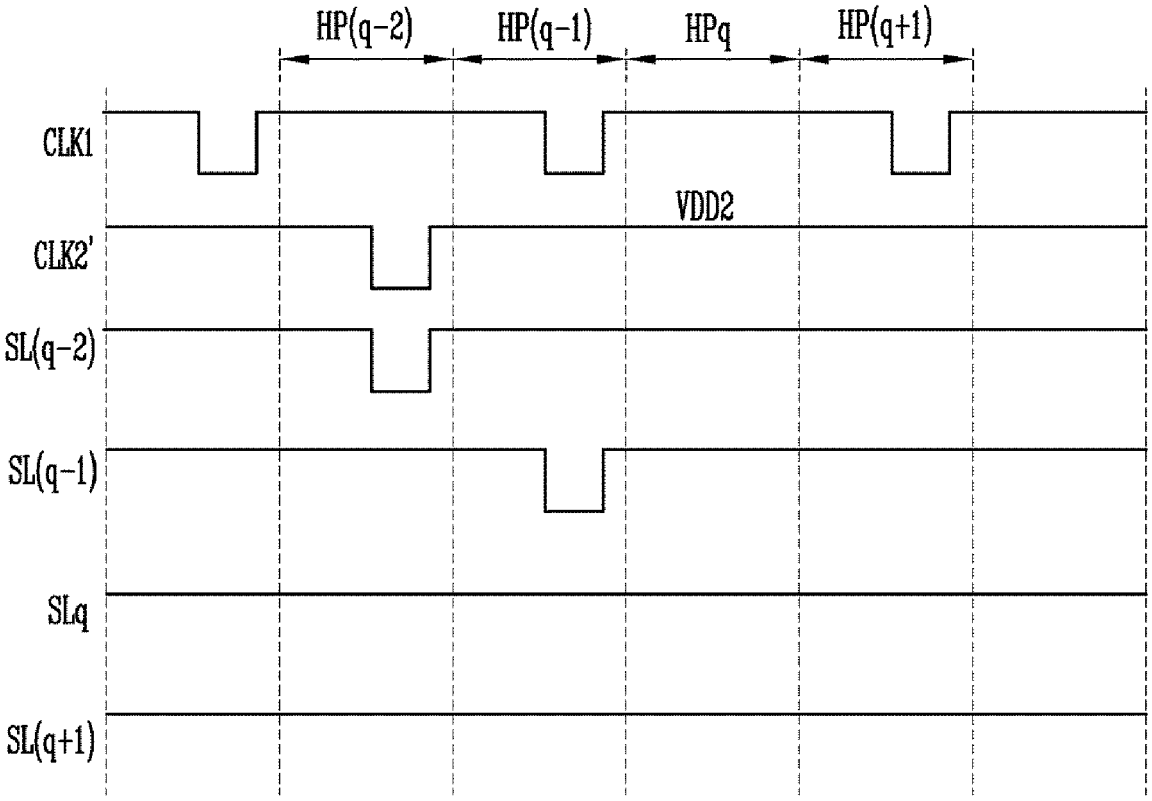

Referring to FIG. 17, a case is assumed where the scan line corresponding to the scan off line number OFFn is the q-th scan line SLq. The clock counter 171 may detect that a counted value corresponds to the scan offline number OFFn in a horizontal period HP(q−2). Thus, the clock counter 171 may turn off the first switch SW1 and turn on the second switch SW2 in response to the control signal SWC. Accordingly, the second high voltage VDD2 may be output as the second clock signal CLK' from a horizontal period HP(q−1). For example, the first high voltage VDD1 and the second high voltage VDD2 may have the same voltage level. Accordingly, in a horizontal period HPq, the q-th scan stage may not output the scan signal of a turn-on level to the q-th scan line SLq. Further, in the corresponding period, the scan stage having a number greater than q may not output the scan signal of a turn-on level to the scan line. In the present embodiment, scan lines from the q-th scan line SLq to the last scan line among the second scan lines may be defined as scan off lines. That is, while the second pixel region AR2 maintains a folded state, a supply of the scan signal of a turn-on level to the scan off line which is a part of the second scan lines may be stopped for at least one frame period.

However, while the second pixel region AR2 maintains a folded state, the number of scan off lines may be changed one or more times. This is because the scan off line number OFFn may be changed one or more times according to the operation of the image scaling unit 16 while the second pixel region AR2 maintains the folded state. However, in order to change the scan off line number OFFn, it may be required that an image shift amount in the second pixel region AR2 is sufficiently large. Thus, the number of times that the number of scan off lines is changed may be equal to or less than the number of times that an image displayed in the second pixel region AR2 is scaled.

Figure 18:
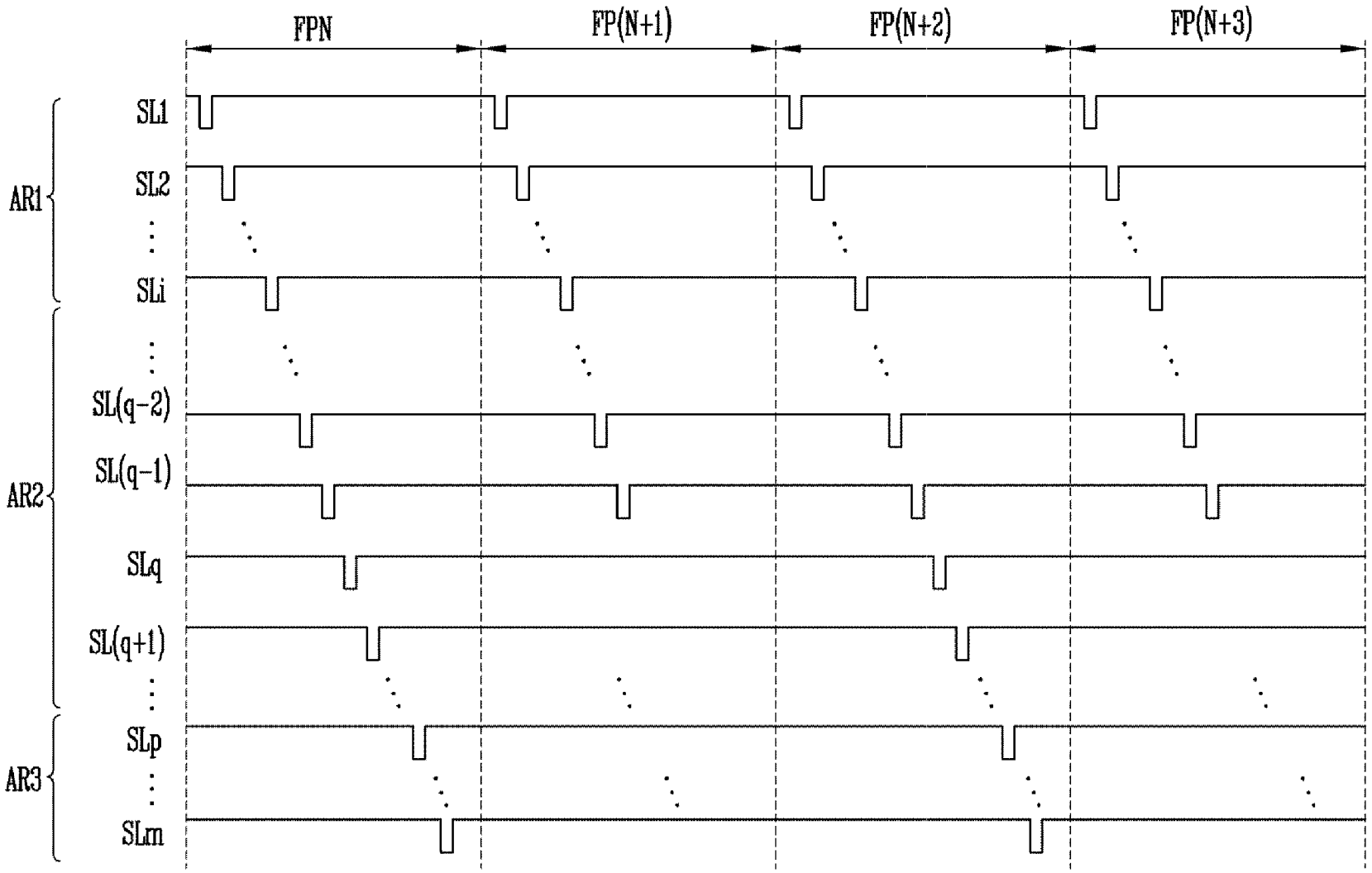

Referring to FIG. 18, four example consecutive frame periods FPN, FP(N+1), FP(N+2), and FP(N+3) are illustrated.

The scan lines SL1 to SL(q−1) may supply the scan signals of a turn-on level during four consecutive frame periods FPN, FP(N+1), FP(N+2), and FP(N+3). Meanwhile, the scan lines SLq to SLm may supply the scan signals of a turn-on level only in two frame periods FP(N+1) and FP(N+3) among the four consecutive frame periods FPN, FP(N+1), FP(N+2), and FP(N+3) according to the operation of the scan off unit 17.

In this case, a first period, which is an image update period of the pixels connected to scan lines SL1 to SL(q−1), may be shorter than a second period, which is an image update period of the pixels connected to the scan lines SLq to SLm. That is, a first drive frequency of the pixels connected to the scan lines SL1 to SL(q−1) may be greater than a second drive frequency of the pixels connected to the scan lines SLq to SLm.

Because the pixels connected to the scan lines SLq to SLm display a black image (or other static image) or do not display an image, the image is not visually recognized to a user as a defect even if the drive frequency is relatively low. Therefore, power consumption of the display device 10 may be reduced.

Further, as described above, while the second pixel region AR2 maintains the folded state, the optimal scan off line number OFFn may be updated by the image scaling unit 16, and power consumption of the display device 10 may be reduced more effectively. For example, in the embodiment of FIG. 18, it is assumed that the scan off line number OFFn corresponds to the q-th scan line SLq, but the scan off line number OFFn may be updated to correspond to the (q−1)-th scan line SL(q−1) or the (q+1)-th scan line SL(q+1) according to image scaling after a time (e.g., a set or predetermined time) elapses.

Figure 19:
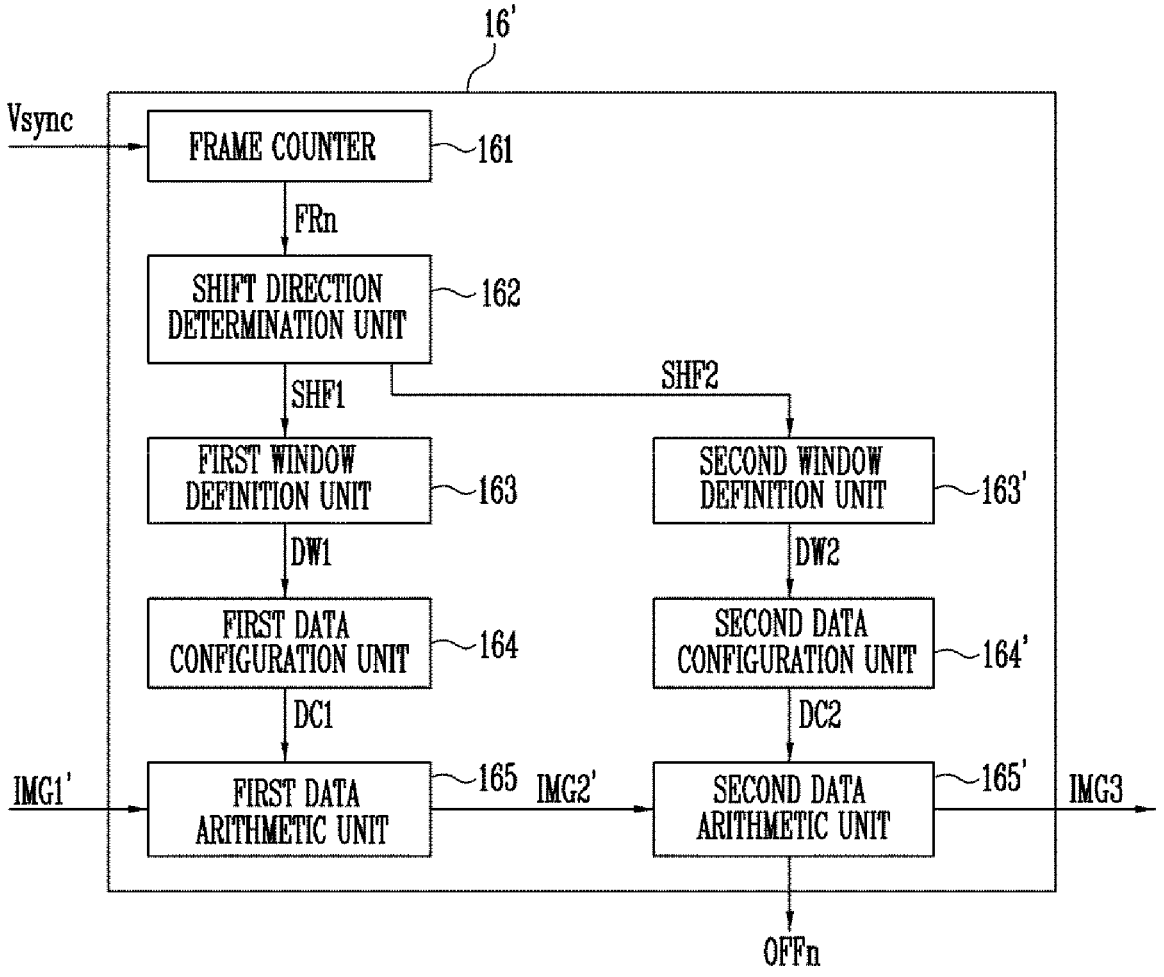
FIG. 19 is a diagram illustrating an image scaling unit according to some example embodiments of the present disclosure.
Figure 20:
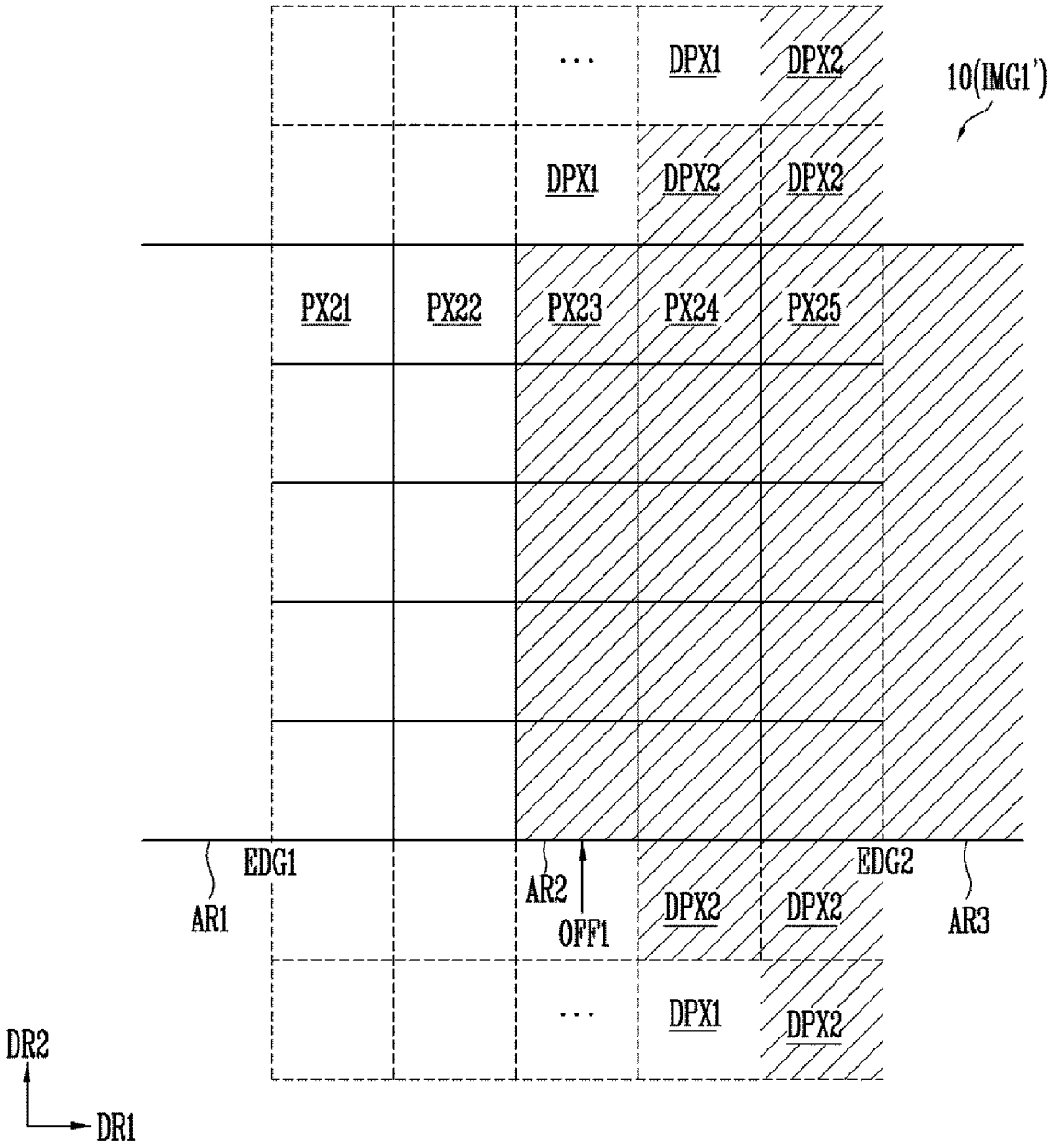
FIGS. 20 and 21 are diagrams illustrating an example operation of the image scaling unit of FIG. 19.
Figure 21:
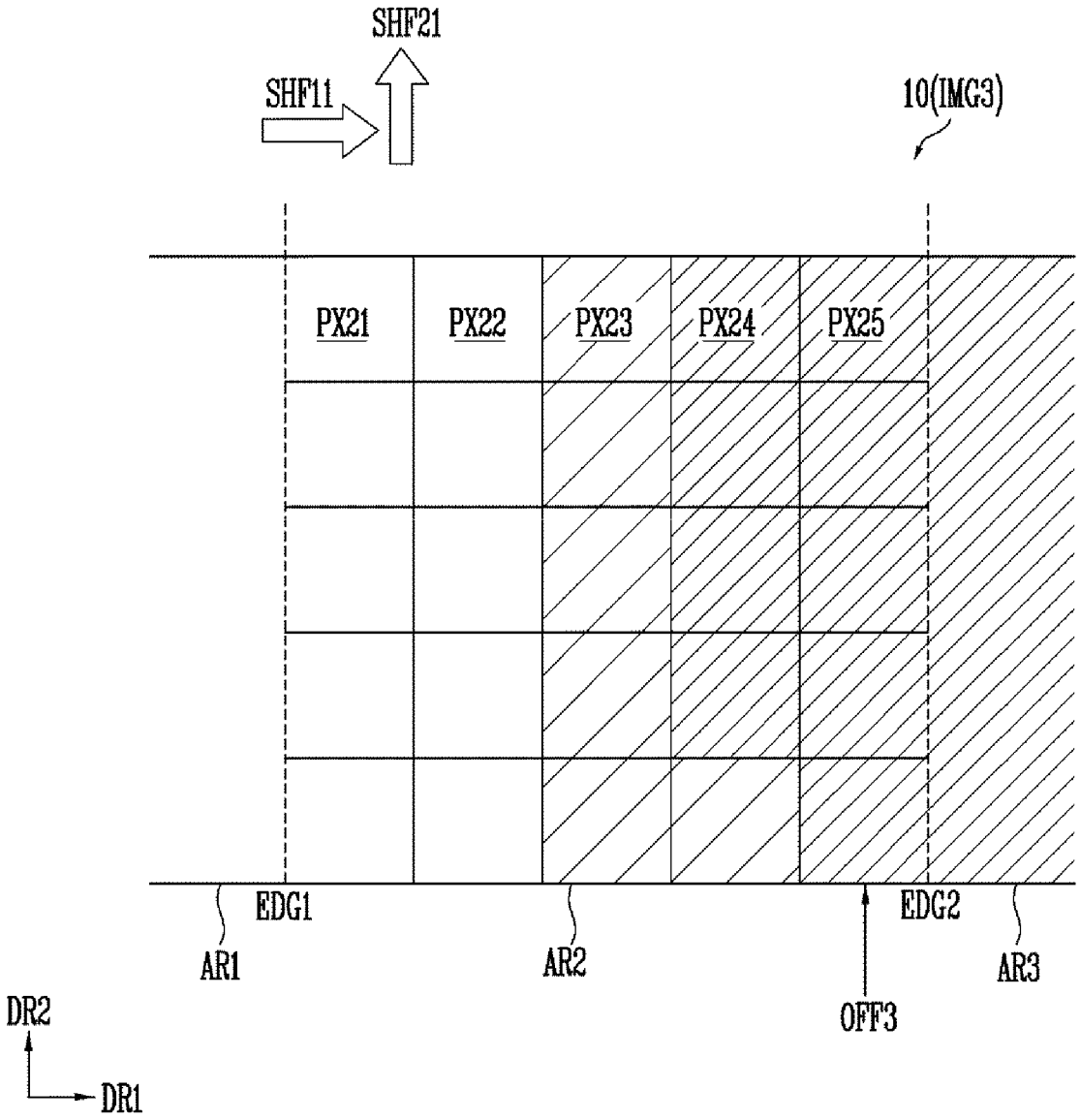

FIG. 19 is a diagram illustrating the image scaling unit according to another embodiment of the present disclosure. FIGS. 20 and 21 are diagrams illustrating an example operation of the image scaling unit of FIG. 19.

An image scaling unit 16' of FIG. 19 may further include a second window definition unit 163', a second data configuration unit 164', and a second data arithmetic unit 165 as compared to the image scaling unit 16 of FIG. 6.

The shift direction determination unit 162 is different from the embodiment of FIG. 6 in that the shift direction determination unit 162 may output not only the first shift information SHF1 of a first image IMG1' but also the second shift information SHF2. A shift direction of the second shift information SHF2 may be the second direction DR2 or a direction opposite to the second direction DR2.

The second window definition unit 163', the second data configuration unit 164', and the second data arithmetic unit 165' perform substantially the same functions as the first window definition unit 163, the first data configuration unit 164, and the first data arithmetic unit 165 except that an arithmetic direction is the second direction DR2, and thus, a redundant description thereon will be omitted, and a difference therebetween will be mainly described.

As described above with reference to FIG. 6, the first data arithmetic unit 165 may convert a first image IMG1' into a second image IMG2'. The second data arithmetic unit 165' may generate a third image IMG3 by converting the second image IMG2' with respect to the second direction DR2 based on the second data configuration information DC2.

In the present embodiment, the scan off line number OFFn may be output by the second data arithmetic unit 165' instead of the first data arithmetic unit 165.

In the present embodiment, the first image IMG1' may further include a dummy grayscale value for dummy pixels DPX1 and DPX2 as compared to the first image IMG1 of FIG. 7. The dummy pixels DPX1 and DPX2 may be virtual pixels that do not exist. For example, the dummy grayscale value of the first dummy pixel DPX1 may be a grayscale value that is seamless with an image of the first pixel region AR1. The dummy grayscale values for the second dummy pixel DPX2 may be a black grayscale value.

Therefore, a shift of the third image IMG3 in the second direction DR2 according to the second shift information SHF21 may be significant. Further, the second data arithmetic unit 165' may output the updated scan off line number OFF3 (see FIG. 21).

The electronic or electric devices and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the example embodiments of the present invention.

The detailed description of the disclosure described with reference to the drawings referred to heretofore is merely an example for the present disclosure, is used only for the purpose of illustrating the present disclosure, and is not used to limit the meaning or the scope of the present disclosure described in the claims and their equivalents. Therefore, those skilled in the art will understand that various modifications and equivalent other embodiments are possible. Accordingly, the true technical protection scope of the present disclosure will have to be defined by the technical idea of the appended claims and their equivalents.

What is claimed is:

1. A display device comprising:

a first pixel region including first pixels connected to a data line and first scan lines;

a second pixel region in contact with the first pixel region at a first boundary and including second pixels connected to the data line and second scan lines; and a third pixel region in contact with the second pixel region at a second boundary and including third pixels connected to the data line and third scan lines, wherein the display device is configured to shift a boundary of an image displayed in the second pixel region at a time interval based on the second pixel region maintaining a folded state.

2. The display device according to claim 1, wherein the display device is configured to display a boundary-unshifted image at the first pixel region based on the second pixel region maintaining the folded state.

3. The display device according to claim 2, wherein the display device is configured to seamlessly display, across the first boundary, a first image in the first pixel region and a second image in the second pixel region based on the second pixel region maintaining the folded state.

4. The display device according to claim 3, wherein the display device is configured to control the third pixel region to not display an image or to display a black image, and to control second pixels of the second pixel region that are in contact with the second boundary to not display the image or to display the black image, based on the second pixel region maintaining the folded state.

5. The display device according to claim 1, wherein the display device is configured to increase a size of an image displayed at a first image region in contact with the first boundary, and wherein the display device is configured to decrease a size of an image displayed at a second image region in contact with the second boundary.

6. The display device according to claim 5, wherein, as the first image region and the second image region increase, a display region in the second pixel region increases and a non-display region in the second pixel region decreases.

7. The display device according to claim 1, wherein the display device is configured to decrease a size of an image displayed at a first image region in contact with the first boundary, and wherein the display device is configured to increase a size of an image displayed at a second image region in contact with the second boundary.

8. The display device according to claim 7, wherein, as the first image region and the second image region increase, a display region in the second pixel region decreases and a non-display region in the second pixel region increases.

9. The display device according to claim 1, wherein, while the second pixel region maintains the folded state, the first pixels and the second pixels in contact with the first boundary update images at a first cycle, and the third pixels and the second pixels in contact with the second boundary update images at a second cycle, and wherein the first cycle is shorter than the second cycle.

10. The display device according to claim 1, wherein each of the second scan lines belongs to one of a first group and a second group, and wherein, while the second pixel region maintains the folded state, voltage levels of scan signals of the second scan lines of the second group are maintained for at least one frame period, and a number of the second scan lines of the second group is changed one or more times.

11. The display device according to claim 10, wherein a number of times that the number of the second scan lines of the second group is changed is less than or equal to a number of times that the boundary of the image displayed in the second pixel region is shifted.

12. A display device comprising:

a first pixel region including first pixels connected to a data line and first scan lines;

a second pixel region in contact with the first pixel region at a first boundary and including second pixels connected to the data line and second scan lines, wherein each of the second scan lines belongs to one of a first group and a second group; and a third pixel region in contact with the second pixel region at a second boundary and including third pixels connected to the data line and third scan lines, wherein the display device is configured to maintain voltage levels of scan signals of the second scan lines of the second group for at least one frame period based on the second pixel region maintaining a folded state, and a number of the second scan lines of the second group is changed one or more times.

13. The display device according to claim 12, wherein the display device is configured to adjust a boundary of an image displayed in the second pixel region based on the second pixel region maintaining the folded state.

14. The display device according to claim 13, wherein a number of times that the number of the second scan lines of the second group is changed is equal to or less than a number of times that the boundary of the image displayed in the second pixel region is shifted.

15. A method of driving a display device, the display device comprising:

a first pixel region including a plurality of first pixels connected to a data line and first scan lines;

a second pixel region in contact with the first pixel region at a first boundary and including a plurality of second pixels connected to the data line and second scan lines; and a third pixel region in contact with the second pixel region at a second boundary and including a plurality of third pixels connected to the data line and third scan lines, the method comprising:

displaying images in the first pixel region, the second pixel region, and the third pixel region when the second pixel region is in an unfolded state;

detecting that the second pixel region is in a folded state; and shifting a boundary of an image displayed in the second pixel region at a time interval based on the second pixel region maintaining the folded state.

16. The method of driving the display device according to claim 15, wherein, while the second pixel region maintains the folded state, the first pixel region displays a boundary-unshifted image, and the image displayed in the first pixel region and the image displayed in the second pixel region are seamless at the first boundary.

17. The method of driving the display device according to claim 15, wherein, while the second pixel region maintains the folded state, the third pixel region does not display an image or displays a black image, and second pixels, which are in contact with the second boundary, of the second pixel region do not display the image or displays the black image.

18. The method of driving the display device according to claim 15, wherein the display device is configured to decrease a size at a second image region, in contact with the second boundary, of an image in the second pixel region, based on a first image region, in contact with the first boundary, of the image in the second pixel region being increased in size, and the display device is configured to increase a size of the second image region based on the first image region being decreased in size.

19. The method of driving the display device according to claim 15, wherein each of the second scan lines belongs to one of a first group and a second group, and wherein the method further comprises:

maintaining voltage levels of scan signals of the second scan lines of the second group for at least one frame period, and changing a number of the second scan lines of the second group one or more times, while the second pixel region maintains the folded state.

20. The method of driving the display device according to claim 19, wherein a number of times that the number of the second scan lines of the second group is changed is less than or equal to a number of times that the boundary of the image displayed in the second pixel region is shifted.

* * * * *